US009248672B2

(12) United States Patent
Sago et al.

(10) Patent No.: US 9,248,672 B2
(45) Date of Patent: Feb. 2, 2016

(54) PRINTER WITH CUTTING DEVICE HAVING HOLDING PORTION FOR HOLDING BLADE IN CUTTING POSITION

(71) Applicant: Brother Kogyo Kabushiki Kaisha, Nagoya-shi, Aichi-ken (JP)

(72) Inventors: Akira Sago, Seto (JP); Ryoya Takahashi, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/492,671

(22) Filed: Sep. 22, 2014

(65) Prior Publication Data

US 2015/0084262 A1 Mar. 26, 2015

(30) Foreign Application Priority Data

Sep. 25, 2013 (JP) ..... 2013-198011
Jan. 24, 2014 (JP) ..... 2014-010994
Apr. 28, 2014 (JP) ..... 2014-092787

(51) Int. Cl.

*B41J 11/70* (2006.01)
*B26D 1/30* (2006.01)
*B41J 11/66* (2006.01)
*B26D 7/00* (2006.01)

(52) U.S. Cl.

CPC ..... *B41J 11/703* (2013.01); *B26D 1/305* (2013.01); *B41J 11/666* (2013.01); *B41J 11/70* (2013.01); *B26D 2007/005* (2013.01)

(58) Field of Classification Search

CPC ..... B41J 11/70; B41J 11/703; B26D 1/305
See application file for complete search history.

(56) References Cited

U.S. PATENT DOCUMENTS 5,671,065 A * 9/1997 Lee ..... 358/304
2013/0202342 A1* 8/2013 Kosuge et al. ..... 400/621

FOREIGN PATENT DOCUMENTS

JP H05-058300 U 8/1993
JP H07-023554 U 5/1995
JP 2001-277184 A 10/2001
JP 3861558 B2 12/2006
JP 2007190651 A * 8/2007 ..... B26D 1/30
JP 2012-183800 A 9/2012

* cited by examiner

*Primary Examiner* — Daniel J Colilla
(74) *Attorney, Agent, or Firm* — Banner & Witcoff, Ltd.

(57) ABSTRACT

A first movable portion has a cutting blade and configured to move between a first retracted position and a first cutting position. A first operating portion is a movable body configured to move in conjunction with a rotation drive portion. The first operating portion is configured to cause the first movable portion to move toward the first cutting position, and to cause the first movable portion to move toward the first retracted position. A drive stopping portion is configured to stop the rotation of the rotation drive portion, when the first movable portion reaches the first cutting position. A position holding portion is configured to hold a position of the first operating portion, when the first movable portion reaches the first cutting position.

17 Claims, 20 Drawing Sheets

PRINTER WITH CUTTING DEVICE HAVING HOLDING PORTION FOR HOLDING BLADE IN CUTTING POSITION

CROSS-REFERENCE TO RELATED APPLICATION

This application claims priority to Japanese Patent Applications No. 2013-198011, filed Sep. 25, 2013, No. 2014-10994, filed Jan. 24, 2014, and No. 2014-92787, filed Apr. 28, 2014. The disclosure of the foregoing applications is incorporated herein by reference in its entirety.

BACKGROUND

The present disclosure relates to a cutting device that is configured to cut a medium, and a printer.

In known art, a printer is known that is provided with a mechanism to cut a medium. For example, a known cutting device is provided with a first cutting mechanism for fully cutting the medium, a second cutting mechanism for half cutting the medium and a single cutter motor that drives the first and second cutting mechanisms.

In the first cutting mechanism, a movable blade moves to a position at which it intersects with a fixed blade due to the driving of the cutter motor in a forward rotational direction. The medium is fully cut by the intersecting movable blade and fixed blade. In the second cutting mechanism, the movable blade moves to a position at which it comes into contact with a receiving base due to the driving of the cutter motor in a reverse rotational direction. The medium is half cut by the movable blade that is pressed against the receiving base while a pressing load is controlled by a torque limiter.

SUMMARY

In the known cutting device, when the half cut operation is performed, the movable blade is held for a predetermined time period in a state in which the movable blade is pressed against the receiving base. In order to hold the movable blade for the predetermined time period in the state in which the movable blade is pressed against the receiving base, the driving of the cutter motor in the reverse rotational direction is performed continuously, and thus the amount of electric power consumed in order to perform the half cut operation is large. Therefore, when the cutting device is driven by a battery, for example, it is possible that the life of the battery may be reduced.

Various embodiments of the broad principles derived herein provide a cutting device that is configured to suppress the amount of power consumption necessary to half cut a medium, and a printer.

The embodiments herein provide a cutting device that includes a receiving base, a first movable portion, a rotation drive portion, a first operating portion, a drive stopping portion, and a position holding portion. The receiving base is configured to receive a medium arranged thereon. The first movable portion has a cutting blade. The cutting blade is configured to cut the medium between the cutting blade and the receiving base. The first movable portion is configured to move between a first retracted position and a first cutting position. The first retracted position is a position in which the cutting blade is separated by at least a specific distance from the receiving base. The first cutting position is a position in which the cutting blade is closer to the receiving base than in the first retracted position. The rotation drive portion is configured to rotate in a first rotation direction and a second rotation direction that are mutually opposite directions. The first operating portion is a movable body configured to move in conjunction with the rotation drive portion. The first operating portion is configured to move in a first movement direction in accordance with rotation of the rotation drive portion in the first rotation direction, and to move in a second movement direction in accordance with rotation of the rotation drive portion in the second rotation direction. The second movement direction is a direction opposite to the first movement direction. The first operating portion is also configured to cause the first movable portion to move toward the first cutting position in accordance with the movement of the first operating portion in the first movement direction, and to cause the first movable portion to move toward the first retracted position in accordance with the movement of the first operating portion in the second movement direction. The drive stopping portion is configured to stop the rotation of the rotation drive portion that rotates in the first rotation direction, when the first movable portion reaches the first cutting position. The position holding portion is configured to hold a position of the first operating portion that moves in the first movement direction, when the first movable portion reaches the first cutting position.

The embodiments herein also provide a printer that includes a receiving base, a printing portion, a supply portion, a first movable portion, a rotation drive portion, a first operating portion, a drive stopping portion, and a position holding portion. The receiving base is configured to receive a medium arranged thereon. The printing portion is configured to print the medium. The supply portion is configured to supply the medium printed by the printing portion to the receiving base. The first movable portion has a cutting blade. The cutting blade is configured to cut the medium between the cutting blade and the receiving base. The first movable portion is configured to move between a first retracted position and a first cutting position. The first retracted position is a position in which the cutting blade is separated by at least a specific distance from the receiving base. The first cutting position is a position in which the cutting blade is closer to the receiving base than in the first retracted position. The rotation drive portion is configured to rotate in a first rotation direction and a second rotation direction that are mutually opposite directions. The first operating portion is a movable body configured to move in conjunction with the rotation drive portion. The first operating portion is configured to move in a first movement direction in accordance with rotation of the rotation drive portion in the first rotation direction, and to move in a second movement direction in accordance with rotation of the rotation drive portion in the second rotation direction. The second movement direction is a direction opposite to the first movement direction. The first operating portion is also configured to cause the first movable portion to move toward the first cutting position in accordance with the movement of the first operating portion in the first movement direction, and to cause the first movable portion to move toward the first retracted position in accordance with the movement of the first operating portion in the second movement direction. The drive stopping portion is configured to stop the rotation of the rotation drive portion that rotates in the first rotation direction, when the first movable portion reaches the first cutting position. The position holding portion is configured to hold a position of the first operating portion that moves in the first movement direction, when the first movable portion reaches the first cutting position.

BRIEF DESCRIPTION OF THE DRAWINGS

Embodiments of the present disclosure will be described below in detail with reference to the accompanying drawings in which.

DETAILED DESCRIPTION

A first embodiment of the present disclosure will be explained with reference to the drawings. In the following explanation, for expediency, the lower right side, the upper left side, the lower left side, the upper right side, the upper side and the lower side of FIG. 1 respectively correspond to the front side, the rear side, the left side, the right side, the upper side and the lower side of a printer 1 and a tape cassette 30. In the present embodiment, various types of tape housed in the tape cassette 30 (a heat-sensitive paper tape, a print tape 57 that will be explained later, a double-sided adhesive tape, a tube tape, or a film tape, for example) are collectively referred to as a tape.

Outline Structure of Printer 1

The printer 1 will be explained with reference to FIG. 1 to FIG. 3. In FIG. 2, for ease of understanding, a top surface of a cassette case 31 is omitted. The printer 1 is a general-purpose tape printer that is configured to use various tape cassettes, such as a thermal type, a receptor type, a laminate type or a tube type etc.

Figure 1:
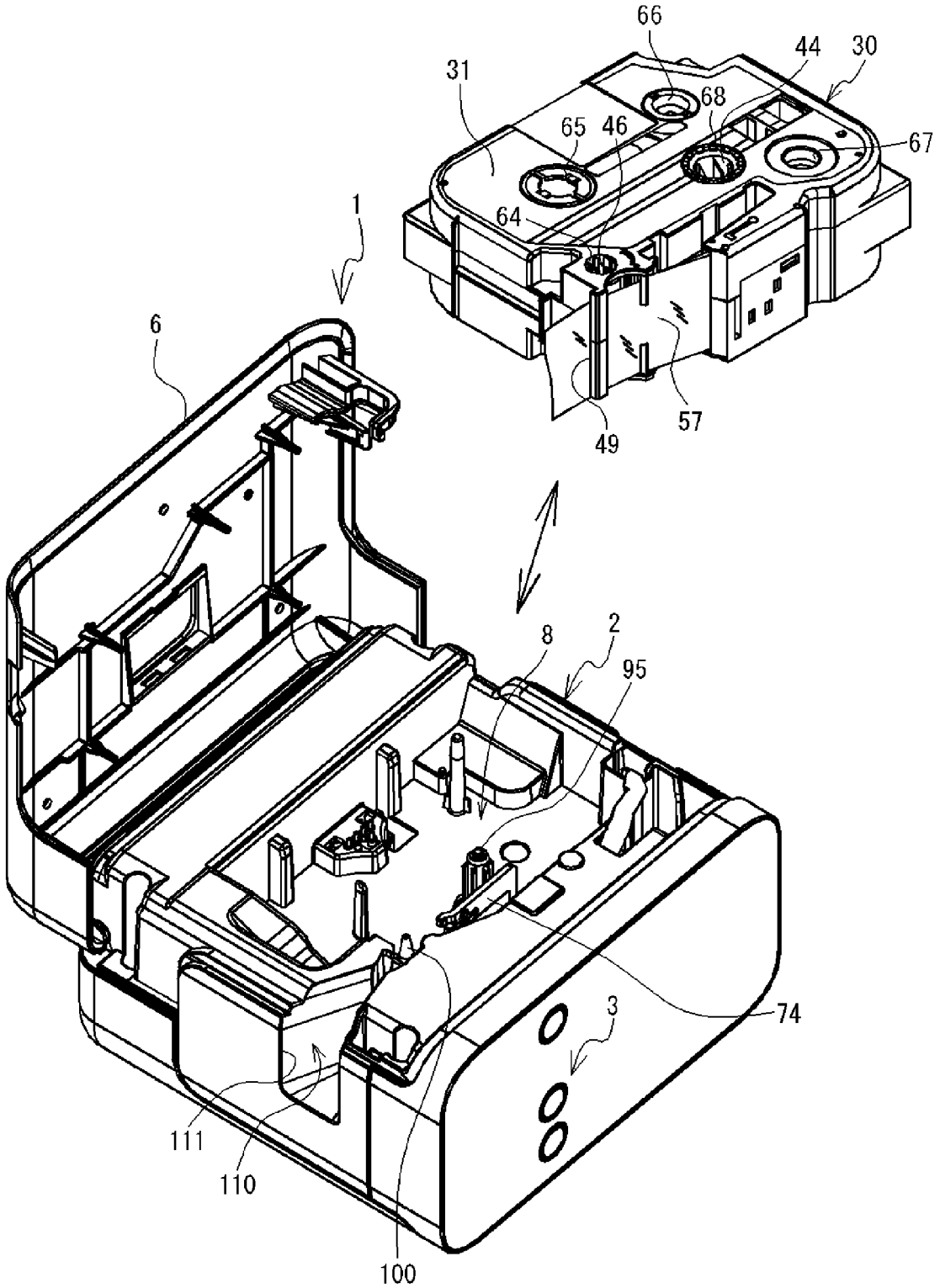
FIG. 1 is a perspective view of a printer and a tape cassette.
Figure 2:
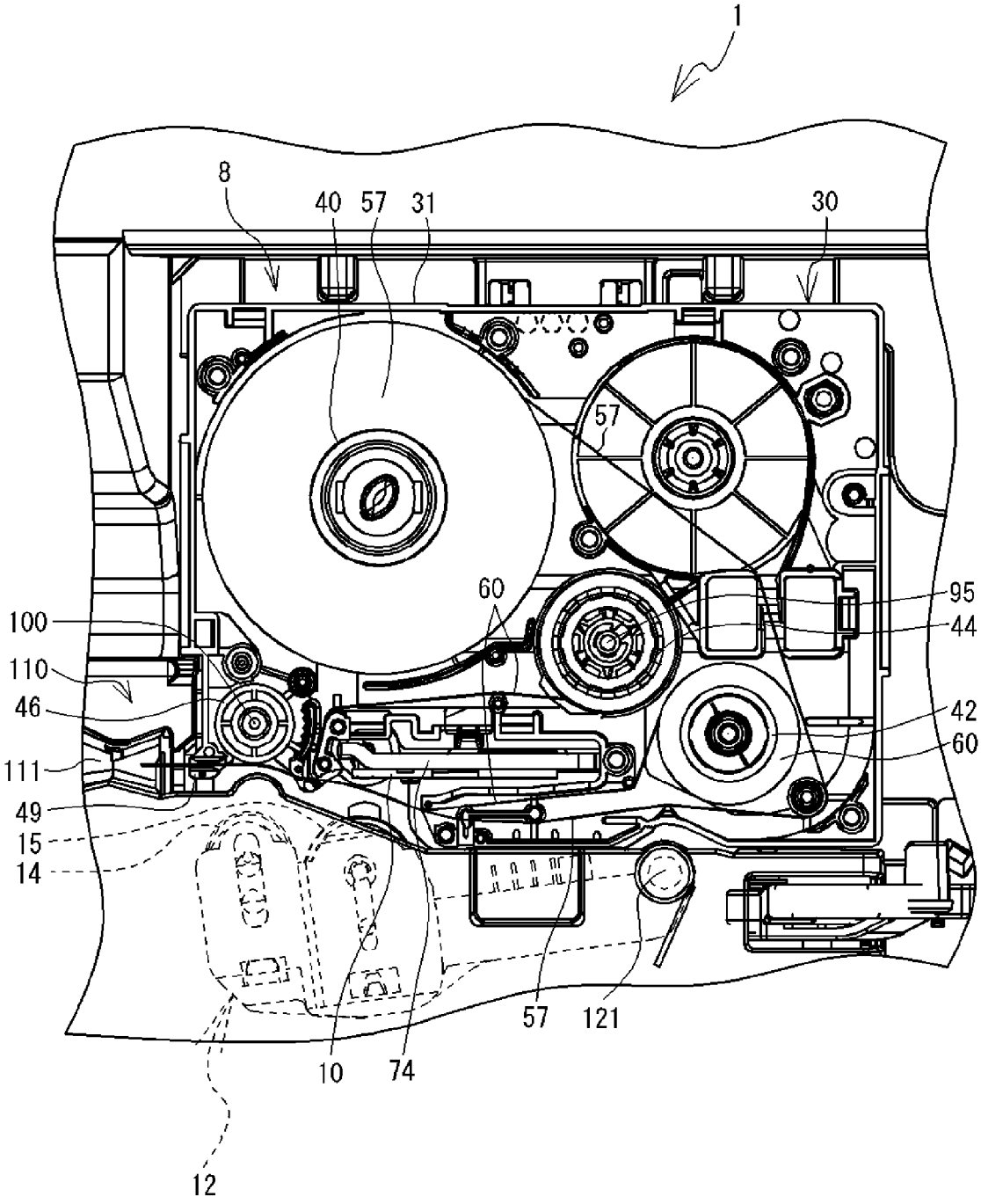
FIG. 2 is a plan view showing a state in which the tape cassette is mounted in a cassette mounting portion.

As shown in FIG. 1, the printer 1 is provided with a substantially cuboid shaped main body cover 2. Switches 3 to operate the printer 1, such as a power switch of the printer 1, are arranged on the front face of the main body cover 2. The printer 1 can be connected to a personal computer (not shown in the drawings, hereinafter referred to as a PC) via a cable (not shown in the drawings) or the like. For example, the printer 1 performs printing of characters on the tape, based on data of characters (letters, numbers, graphics etc.) transmitted from the PC.

On the top surface of the printer 1, a cassette cover 6 is provided, which is opened and closed when replacing the tape cassette 30. The cassette cover 6 is a lid portion that is substantially rectangular in a plan view. The cassette cover 6 is axially supported at both left and right end portions, at the top of the rear surface of the main body cover 2. A cassette mounting portion 8, which is an area into and from which the tape cassette 30 can be mounted and removed, is provided in the main body cover 2. The cassette cover 6 can rotate between a closed position (not shown in the drawings) in which it closes off the cassette mounting portion 8 and an open position (refer to FIG. 1) in which it opens up the cassette mounting portion 8.

A discharge port 111 is provided in the left side surface of the main body cover 2. The discharge port 111 is an opening through which the printed tape is discharged from the cassette mounting portion 8. The main body cover 2 has a tape discharge portion 110, which forms a feed path of the printed tape, between the cassette mounting portion 8 and the discharge port 111. A cutting mechanism 80 (refer to FIG. 3), which will be explained later, is provided in the tape discharge portion 110.

As shown in FIG. 1 and FIG. 2, a head holder 74 is provided in a standing manner on a front portion of the cassette mounting portion 8. The front surface of the head holder 74 is provided with a thermal head 10 that includes a heating element (not shown in the drawings). A ribbon take-up shaft 95 is provided in a standing manner to the rear of the head holder 74. The ribbon take-up shaft 95 is a shaft-shaped member that can be mounted on and removed from a ribbon take-up spool 44 of the tape cassette 30. A tape drive shaft 100 is provided in a standing manner to the left of the head holder 74. The tape drive shaft 100 is a shaft-shaped member that can be mounted on and removed from a tape drive roller 46 of the tape cassette 30.

A platen holder 12, which can pivot around a shaft support portion 121, is disposed to the front of the head holder 74. A platen roller 15 and a movable feed roller 14 are rotatably and axially supported on the left end portion of the platen holder 12. The platen roller 15 faces the thermal head 10 and can come into contact with or be separated from the thermal head 10. The movable feed roller 14 faces the tape drive roller 46 that is mounted on the tape drive shaft 100, and can come into contact with or be separated from the tape drive roller 46. A tape drive motor 711 (refer to FIG. 4), which is a stepping motor, is disposed below the cassette mounting portion 8.

Figure 3:
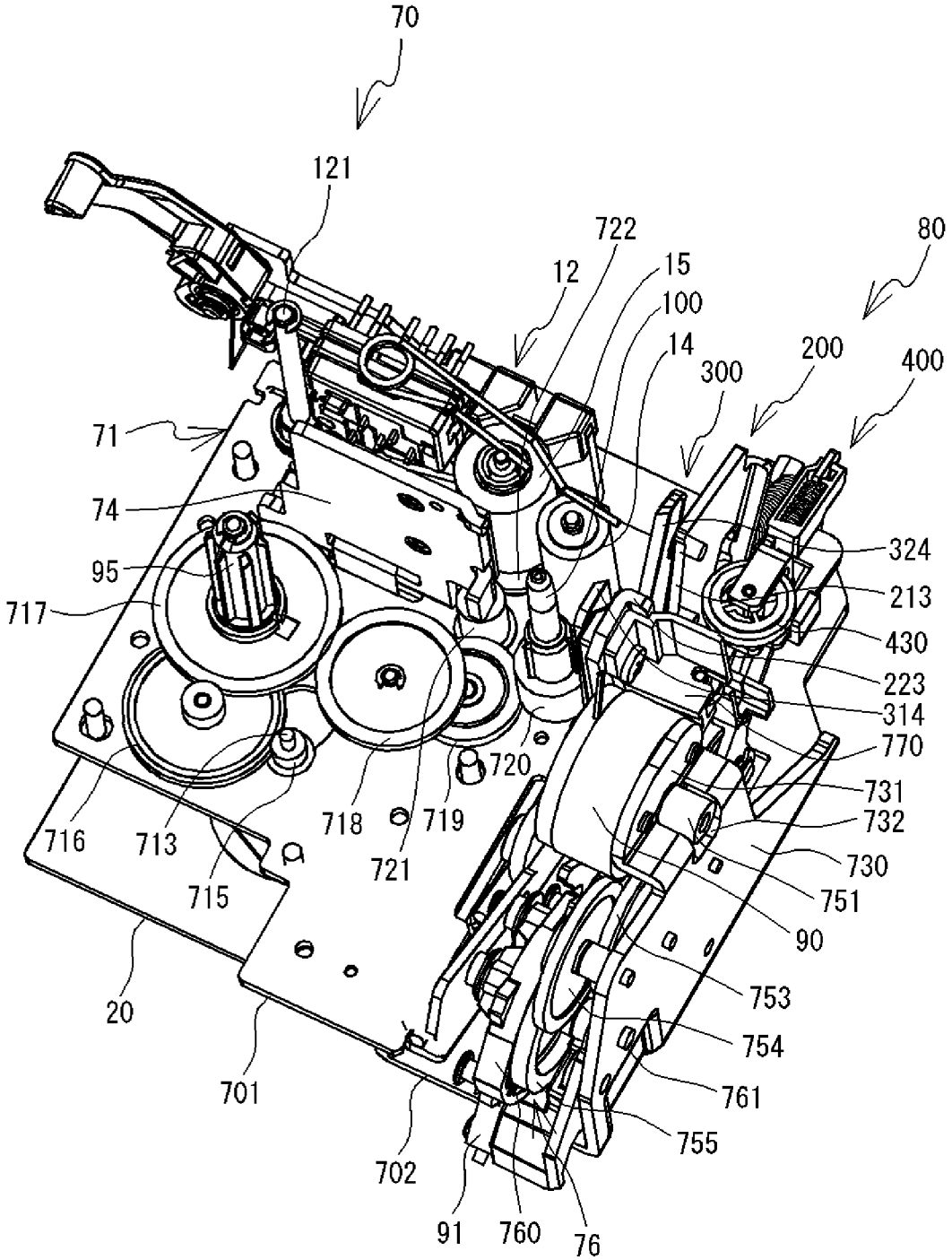
FIG. 3 is a perspective view of a unit as seen from diagonally above.

As shown in FIG. 2 and FIG. 3, when the cassette cover 6 (refer to FIG. 1) is rotated from the open position to the closed position, the platen holder 12 moves toward a printing position. The platen holder 12 that has moved to the printing position is in close proximity to the cassette mounting portion 8. At this time, a gear 722 that is provided below the platen roller 15 meshes with a gear 721 and a gear (not shown in the drawings) that is provided below the movable feed roller 14 meshes with a gear 720.

Overview of Structure of Tape Cassette 30

The tape cassette 30 will be explained with reference to FIG. 1 and FIG. 2. The tape cassette 30 is a general-purpose cassette in which, by changing the type of the tape housed internally and the presence or absence of an ink ribbon etc., as appropriate, the above-described thermal type, receptor type, laminate type and tube type or the like can be mounted. FIG. 2 illustrates the receptor type tape cassette 30.

The tape cassette 30 is provided with a box-shaped cassette case 31. A discharge guide portion 49, which guides the tape that is discharged from the tape cassette 30, is provided in a front left portion of the cassette case 31. The cassette case 31 has support holes 65 to 68 that rotatably support a spool or the like mounted inside the cassette case 31. The support hole 65 rotatably supports a first tape spool 40 around which a first tape is wound. The support hole 67 rotatably supports a ribbon spool 42 around which an unused ink ribbon 60 is wound. The support hole 68 rotatably supports the ribbon take-up spool 44 that is used to take up the used ink ribbon 60. The support hole 66 rotatably supports a second tape spool (not shown in the drawings) around which a second tape is wound.

In the receptor type tape cassette 30 shown in FIG. 2, the support hole 65 supports the first tape spool 40 around which the print tape 57, which is the first tape, is wound. The print tape 57 of the present embodiment is a laminated tape in which a print layer and a release layer are laminated together with adhesive. The second tape is not used in the receptor type tape cassette 30 and the support hole 66 does not support the second tape spool.

Although not shown in the drawings, in the laminate type tape cassette 30, the support hole 65 supports the first tape spool 40 around which a double-sided adhesive tape, which is the first tape, is wound. The support hole 66 supports the second tape spool around which a film tape, which is the second tape, is wound.

Overview of Structure of Unit 70

Figure 4:
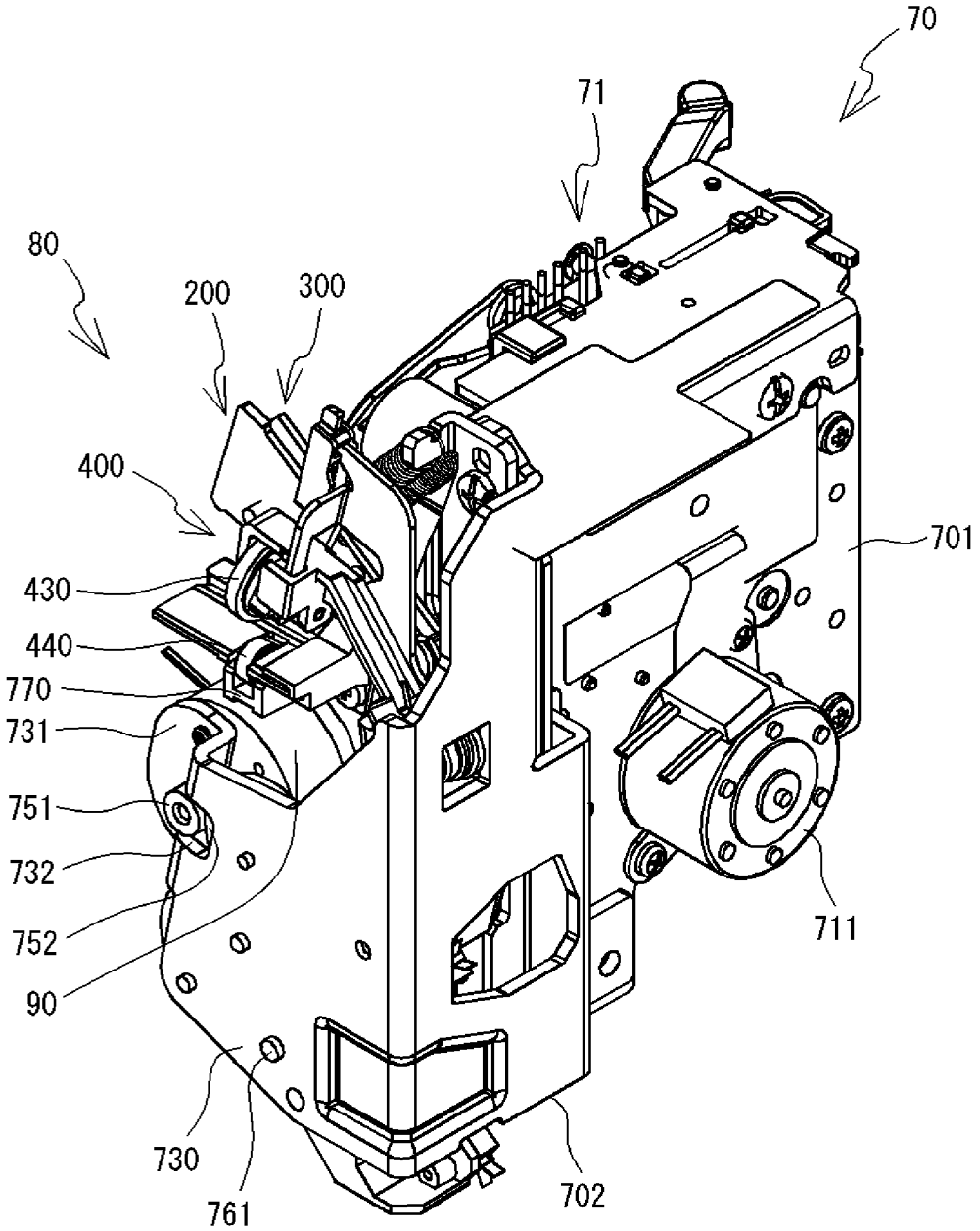
FIG. 4 is a perspective view of the unit as seen from diagonally below.

A unit 70 will be explained with reference to FIG. 3 and FIG. 4. The upper right side, the lower left side, the lower right side, the upper left side, the upper side and the lower side of FIG. 3 respectively correspond to the front side, the rear side, the left side, the right side, the upper side and the lower side of the tape printer 1 shown in FIG. 1 and FIG. 2. In FIG. 3 and FIG. 4, illustration of the exterior of the platen holder 12 shown in FIG. 2 is omitted. In FIG. 4, illustration of a control portion 20 is omitted.

The unit 70 is provided with a first frame 701, a second frame 702, a printing mechanism 71 and the cutting mechanism 80. The first frame 701 is a plate-shaped metal frame that extends in the front-rear and left-right directions and is disposed below the cassette mounting portion 8 (refer to FIG. 1). The printing mechanism 71 is a mechanism for printing characters on the tape and is disposed on the first frame 701. The printing mechanism 71 includes the head holder 74, the thermal head 10 (refer to FIG. 2), the platen holder 12, the platen roller 15, the movable feed roller 14, the ribbon take-up shaft 95, the tape drive shaft 100, a tape drive motor 711 and gears 715 to 722 etc.

The tape drive motor 711 and the control portion 20 are disposed below the first frame 701. A drive shaft 713 of the tape drive motor 711 protrudes to the upper side of the first frame 701 via a hole (not shown in the drawings) that is provided in the first frame 701. The gear 715 is fixed to the drive shaft 713 above the first frame 701. The gear 715 meshes with the gear 716. The gear 717 meshes with the gear 716 and the gear 718. The gear 719 meshes with the gear 718, the gear 720 and the gear 721. The ribbon take-up shaft 95 is provided in a standing manner on the top surface of the gear 717. The tape drive shaft 100 is provided in a standing manner on the top surface of the gear 720.

The control portion 20 is an electrical substrate that has a CPU, a ROM and a RAM etc. The control portion 20 controls various operations of the printer 1 by causing the CPU to execute programs stored in the ROM.

The second frame 702 is a plate-shaped metal frame that extends in the front-rear and left-right directions, and is screwed to the left side of the first frame 701. The second frame 702 is disposed below the tape discharge portion 110 (refer to FIG. 1). The second frame 702 has a support plate 730 that extends upward from the left end of the second frame 702. The cutting mechanism 80 is disposed on the second frame 702. The cutting mechanism 80 is a mechanism that is configured to cut the printed tape. An attachment plate 731, which extends to the right from the support plate 730, is provided on an upper end portion of the support plate 730. A cutter drive motor 90, which will be explained later, is fixed to the right surface of the attachment plate 731.

Overview of Operations of Printer 1

An overview of the operations of the printer 1 will be explained with reference to FIG. 2. In the example shown in FIG. 2, the receptor type tape cassette 30 is mounted in the cassette mounting portion 8. In this case, when the platen holder 12 moves to the printing position, the platen roller 15 presses the thermal head 10 via the print tape 57 and the ink ribbon 60. At the same time, the movable feed roller 14 presses the tape drive roller 46 via the print tape 57.

The control portion 20 (refer to FIG. 3) drives the tape drive motor 711 (refer to FIG. 4) at the same time as executing the printing operation. The driven tape drive motor 711 rotates the ribbon take-up shaft 95, the tape drive shaft 100, the movable feed roller 14 and the platen roller 15 via the gears 715 to 722 (refer to FIG. 3). The unused ink ribbon 60 is pulled out from the ribbon spool 42 by the ribbon take-up shaft 95 rotating the ribbon take-up spool 44. The print tape 57 that is clamped between the tape drive roller 46 and the movable feed roller 14 is fed by the tape drive shaft 100 rotating the tape drive roller 46, and the unused print tape 57 is pulled out from the first tape spool 40.

In a section between the platen roller 15 and the thermal head 10, the thermal head 10 uses the unused ink ribbon 60 to perform printing on the print layer of the unused print tape 57. The printed print tape 57 is fed to the tape discharge portion 110 and is cut by the cutting mechanism 80 (refer to FIG. 3) that will be explained later. The cut print tape 57 is discharged from the discharge port 111.

Overview of Structure of Cutting Mechanism 80

Figure 11:
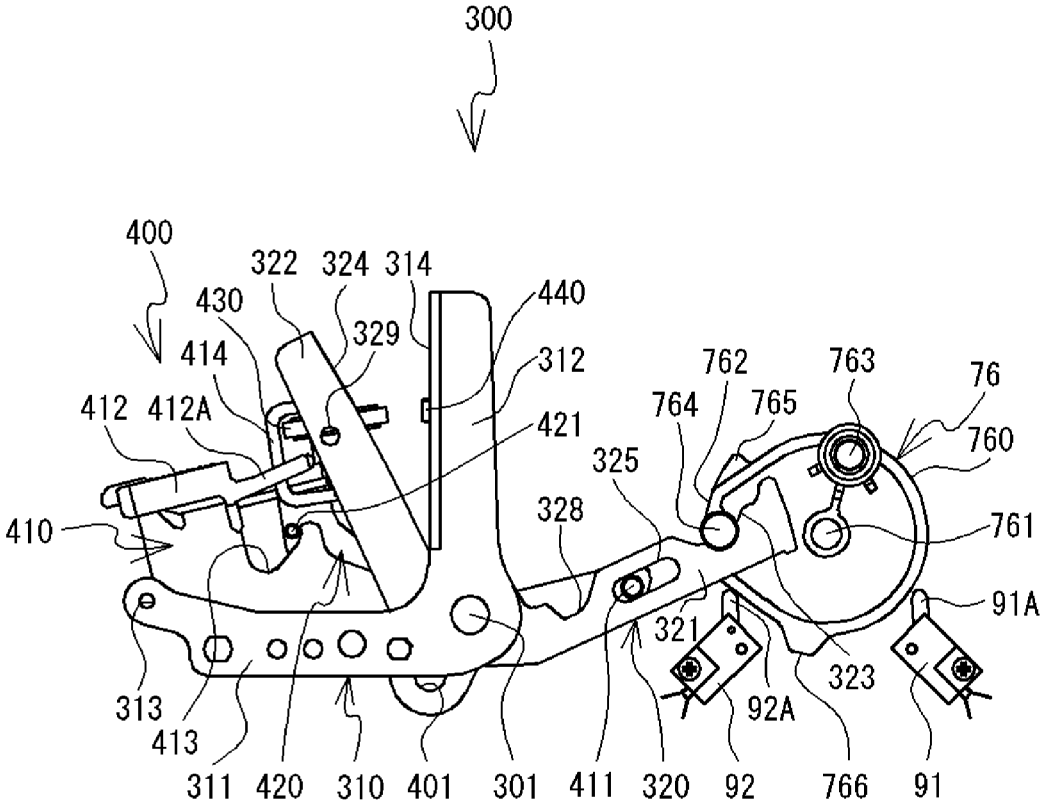
FIG. 11 is a front view of a full-cut mechanism and a feed mechanism when the cam plate is in the reference rotation position.
Figure 12:
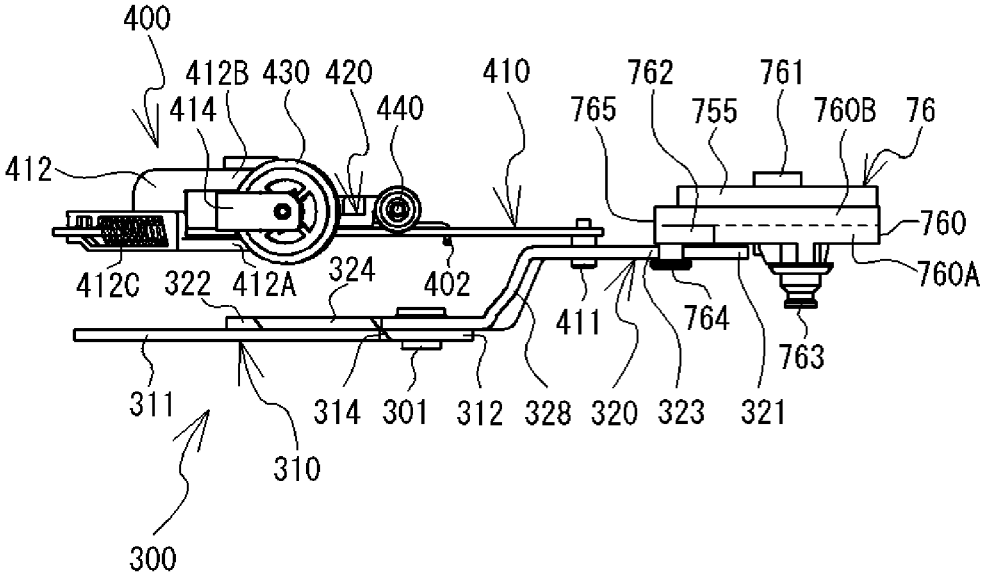
FIG. 12 is a plan view of the full-cut mechanism and the feed mechanism when the cam plate is in the reference rotation position.

The cutting mechanism 80 will be explained with reference to FIG. 3 to FIG. 19. In the following explanation, for expediency, the upper left side, the lower right side, the upper right side, the lower left side, the upper side and the lower side of FIG. 3 respectively correspond to the front side, the rear side, the left side, the right side, the upper side and the lower side of the cutting mechanism 80. For ease of understanding, in FIG. 11 and FIG. 12, illustration of an extension spring 330 is omitted from a full-cut mechanism 300. FIG. 11 illustrates detection sensors 91 and 92 along with a cam plate 760.

Figure 5:
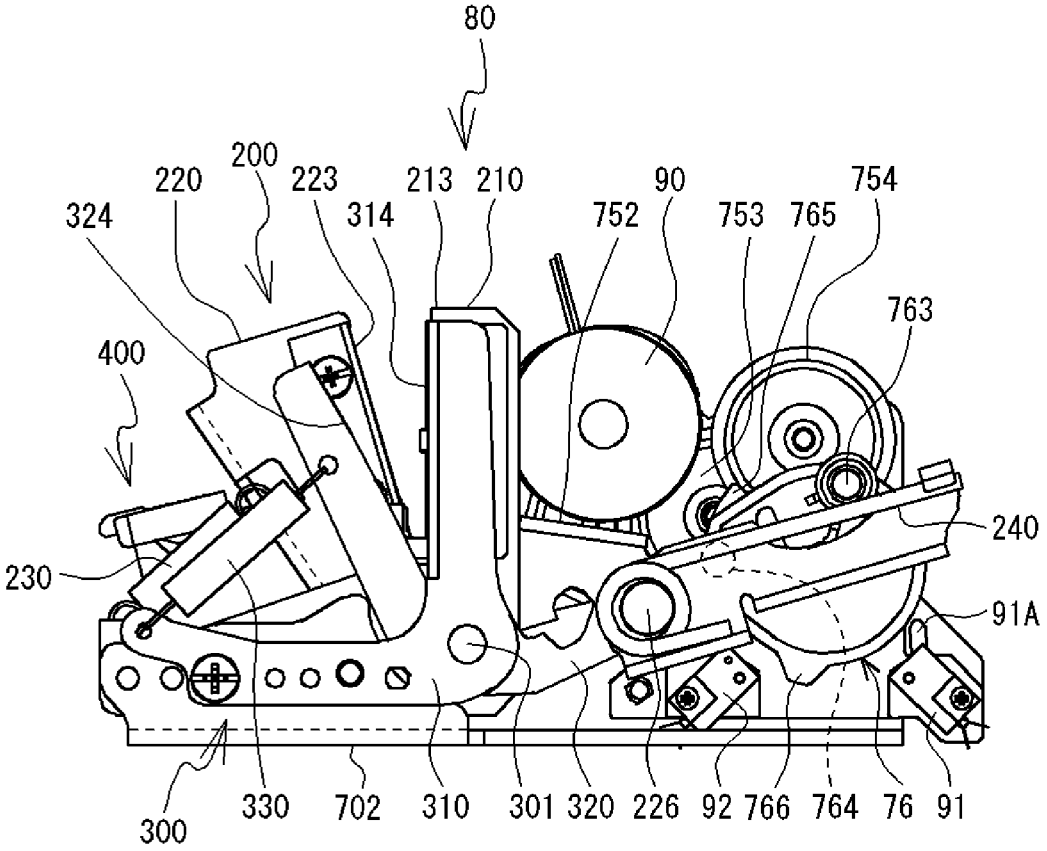
FIG. 5 is a front view of a cutting device in a stand-by state.

As shown in FIG. 3 to FIG. 5, the cutting mechanism 80 includes a half-cut mechanism 200, the full-cut mechanism 300, a feed mechanism 400, the cutter drive motor 90, gears 751 to 755, and a drive cam 76 etc. The full-cut mechanism 300, the half-cut mechanism 200 and the feed mechanism 400 are disposed in the tape discharge portion 110 (refer to FIG. 1) along a tape feed path. The full-cut mechanism 300 is disposed to the rear of the cassette mounting portion 8. The feed mechanism 400 is disposed to the front of the discharge port 111. The half-cut mechanism 200 is disposed between the full-cut mechanism 300 and the feed mechanism 400.

The gear 751 that is attached to a drive shaft (not shown in the drawings) of the cutter drive motor 90 is disposed inside a hole portion 732 that penetrates the attachment plate 731. The respective gears 752 to 755 rotate around shaft portions that extend to the front from the attachment plate 731. The gear 752 meshes with the gear 751. The gear 753 meshes with the gear 752. The gear 754 meshes with the gear 753. The gear 755 meshes with the gear 754.

As shown in FIG. 6 to FIG. 9, the drive cam 76 includes the gear 755, the cam plate 760 and a shaft portion 761. The cam plate 760 is a disk-shaped plate that is larger than the gear 755, and is fixed to the front of the gear 755. The gear 755 and the cam plate 760 can rotate integrally around the shaft portion 761 that extends in the front-rear direction. Apart from a protruding portion 762, a distance from the shaft portion 761 to a peripheral surface of the cam plate 760 (namely, the radius of the cam plate 760) is substantially the same. The protruding portion 762 is a portion of the cam plate 760 that protrudes to the outside in a radial direction.

Figure 9:
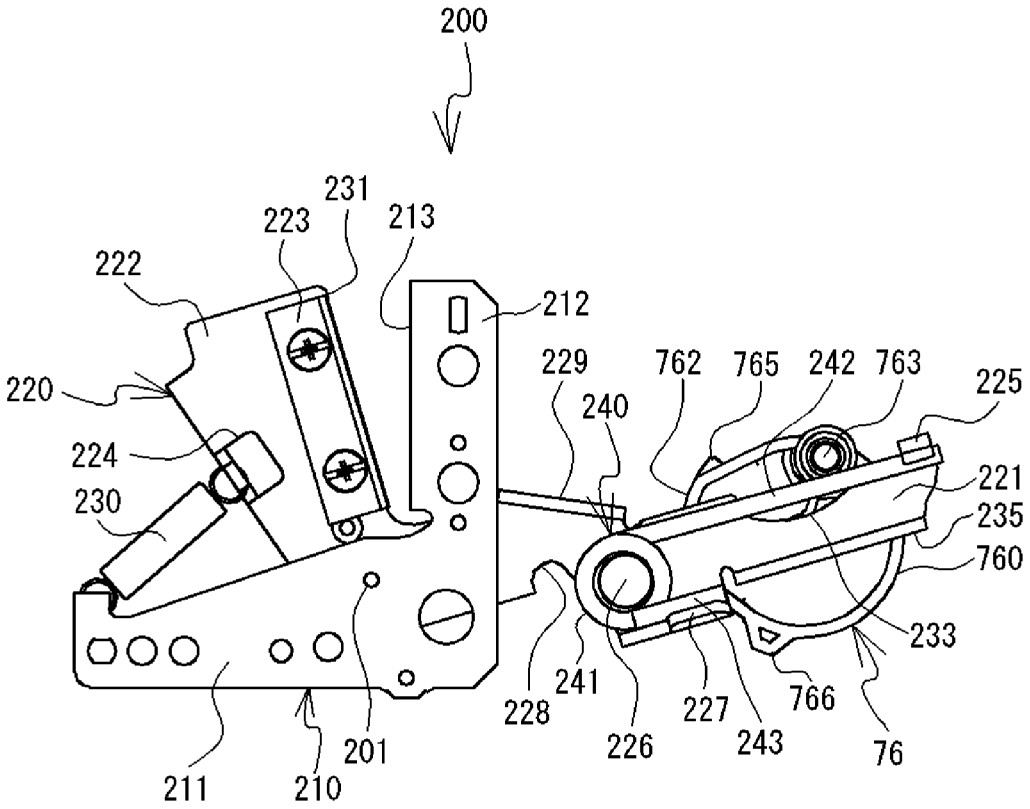
FIG. 9 is a front view of the half-cut mechanism when the cam plate is in the reference rotation position.
Figure 10:
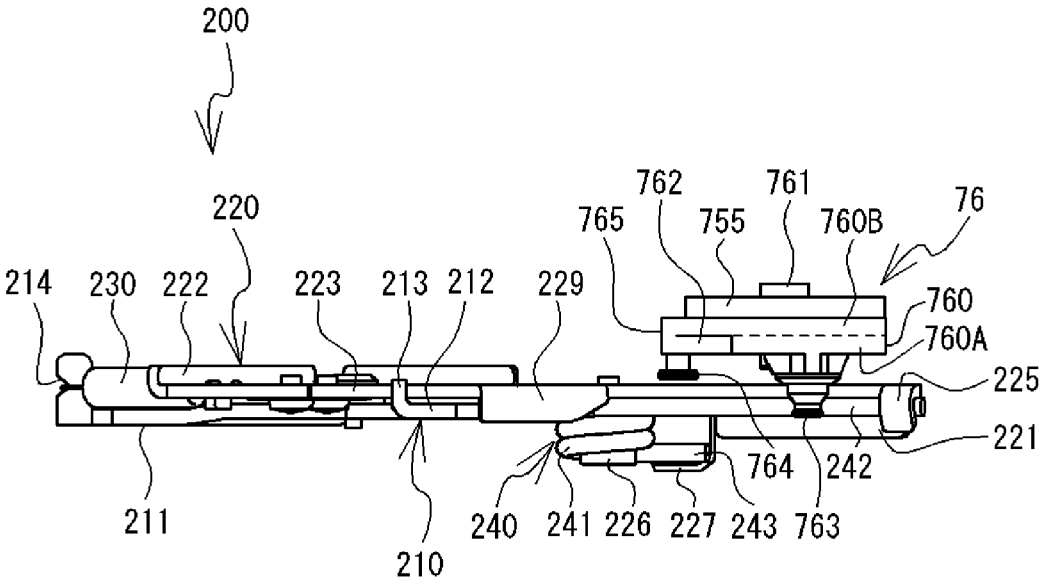
FIG. 10 is a plan view of the half-cut mechanism when the cam plate is in the reference rotation position.

As shown in FIG. 9 and FIG. 10, a first drive pin 763, a second drive pin 764, a first detection plate 765 and a second detection plate 766 are provided on the cam plate 760. Each of the first drive pin 763 and the second drive pin 764 is a circular column that protrudes to the front from the cam plate 760. More specifically, the second drive pin 764 protrudes to the front from the protruding portion 762. The first drive pin 763 protrudes to the front from an outer edge portion of the cam plate 760 that is different to the protruding portion 762. The first drive pin 763 is provided in a position at a substantially 90 degree rotation, with respect to the second drive pin 764, in the clockwise direction around the shaft portion 761 in a front view. The first drive pin 763 extends further to the front than the second drive pin 764.

Figure 8:
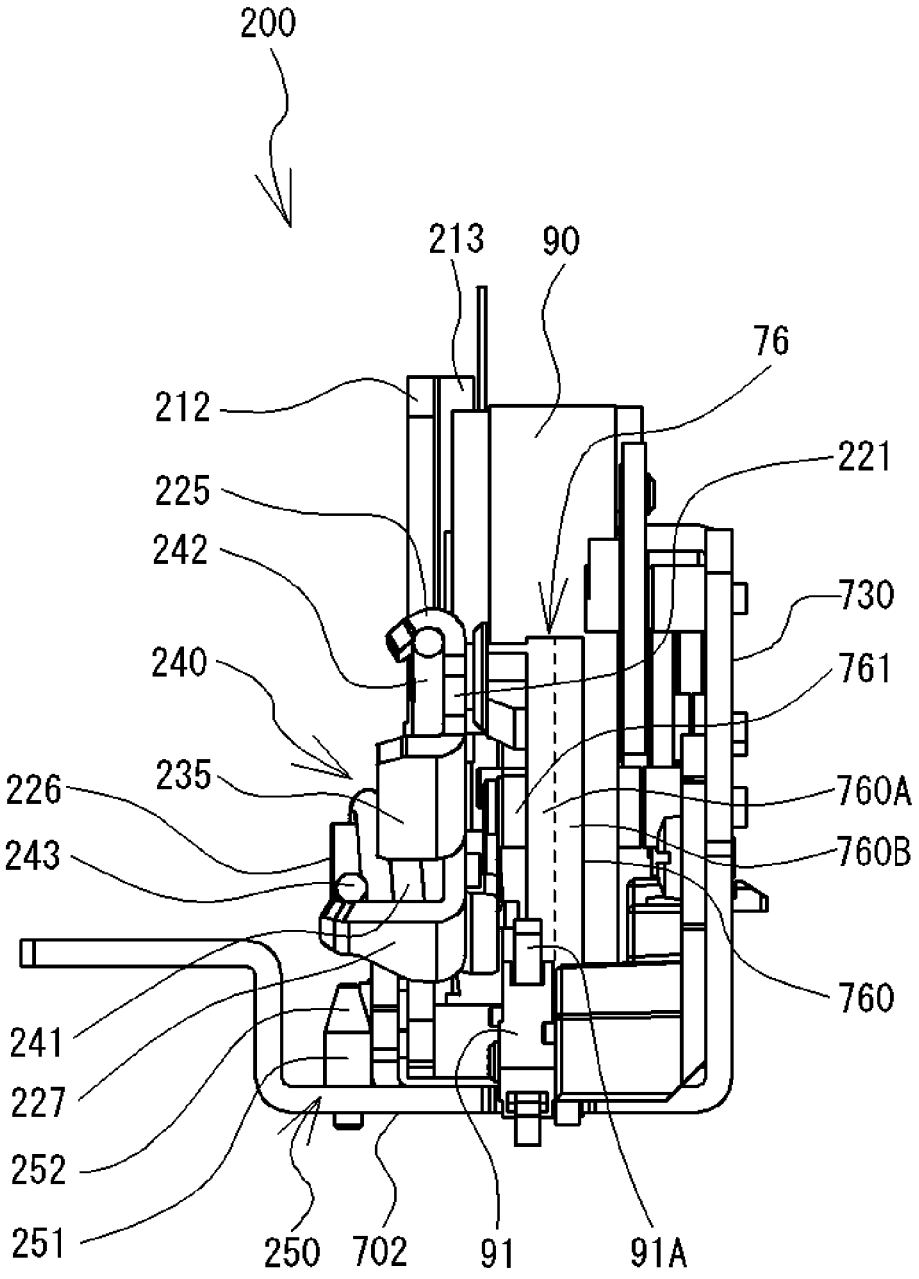
FIG. 8 is a right side view of the half-cut mechanism when the cam plate is in the reference rotation position.

As shown in FIG. 8 and FIG. 10, the peripheral surface of the cam plate 760 includes a front peripheral surface 760A and a rear peripheral surface 760B. The front peripheral surface 760A is a peripheral surface of the cam plate 760 that is on the front side of substantially the center of the cam plate 760 in the front-rear direction. The rear peripheral surface 760B is a peripheral surface that is on the rear side of substantially the center of the cam plate 760 in the front-rear direction. The above-described protruding portion 762 forms a part of the front peripheral surface 760A.

The first detection plate 765 is a plate-shaped body that protrudes to the outside in a radial direction from the rear peripheral surface 760B. The first detection plate 765 is provided to the rear of the protruding portion 762. The second detection plate 766 is a plate-shaped body that protrudes to the outside in a radial direction from the front peripheral surface 760A. The second detection plate 766 is provided in a position at a substantially 90 degree rotation from the protruding portion 762 in the counter-clockwise direction around the shaft portion 761 in a front view. A distance from a protruding end of the first detection plate 765 to the shaft portion 761 is equal to a distance from a protruding end of the second detection plate 766 to the shaft portion 761.

As shown in FIG. 5 and FIG. 8, the two detection sensors 91 and 92 are provided below the cam plate 760. The detection sensor 91 is a mechanical sensor that has a movable pin 91A and that is provided below a right end portion of the cam plate 760. The movable pin 91A extends upward toward the front peripheral surface 760A from a rotating shaft (not shown in the drawings) that extends in the front-rear direction. When the movable pin 91A is in a steady state in which it extends upward, the detection sensor 91 outputs an OFF signal. When the movable pin 91A rotates in the clockwise direction in a front view, the movable pin 91A changes to a tilted state. When the movable pin 91A is in the tilted state, the detection sensor 91 outputs an ON signal.

The detection sensor 92 is a mechanical sensor that has a movable pin 92A (refer to FIG. 11) and that is provided below a left end portion of the cam plate 760. The movable pin 92A extends upward toward the rear peripheral surface 760B from a rotating shaft (not shown in the drawings) that extends in the front-rear direction. When the movable pin 92A is in a steady state in which it extends upward, the detection sensor 92 outputs an OFF signal. When the movable pin 92A rotates from the steady state in the counter-clockwise direction in a front view, the movable pin 92A changes to a tilted state. When the movable pin 92A is in the tilted state, the detection sensor 92 outputs an ON signal.

Detailed Structure of Half-Cut Mechanism 200

The half-cut mechanism 200 will be explained with reference to FIG. 6 to FIG. 10. The half-cut mechanism 200 is a mechanism that is configured to cut only part of layers of the tape in which a plurality of layers are laminated. The half-cut mechanism 200 includes a fixed portion 210, a movable portion 220, an extension spring 230, a compression spring 240 and a regulating pin 250.

Figure 6:
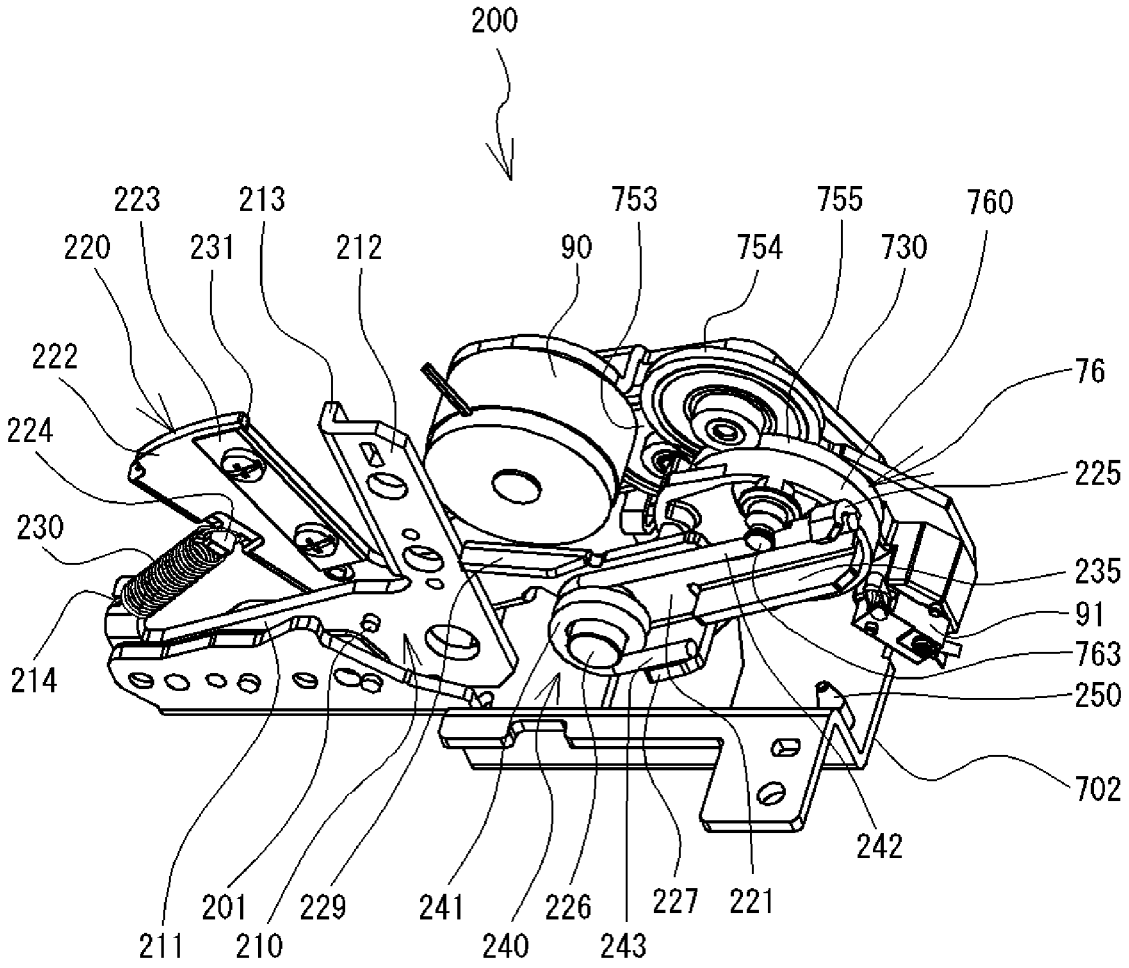
FIG. 6 is a perspective view of a half-cut mechanism when a cam plate is in a reference rotation position.
Figure 7:
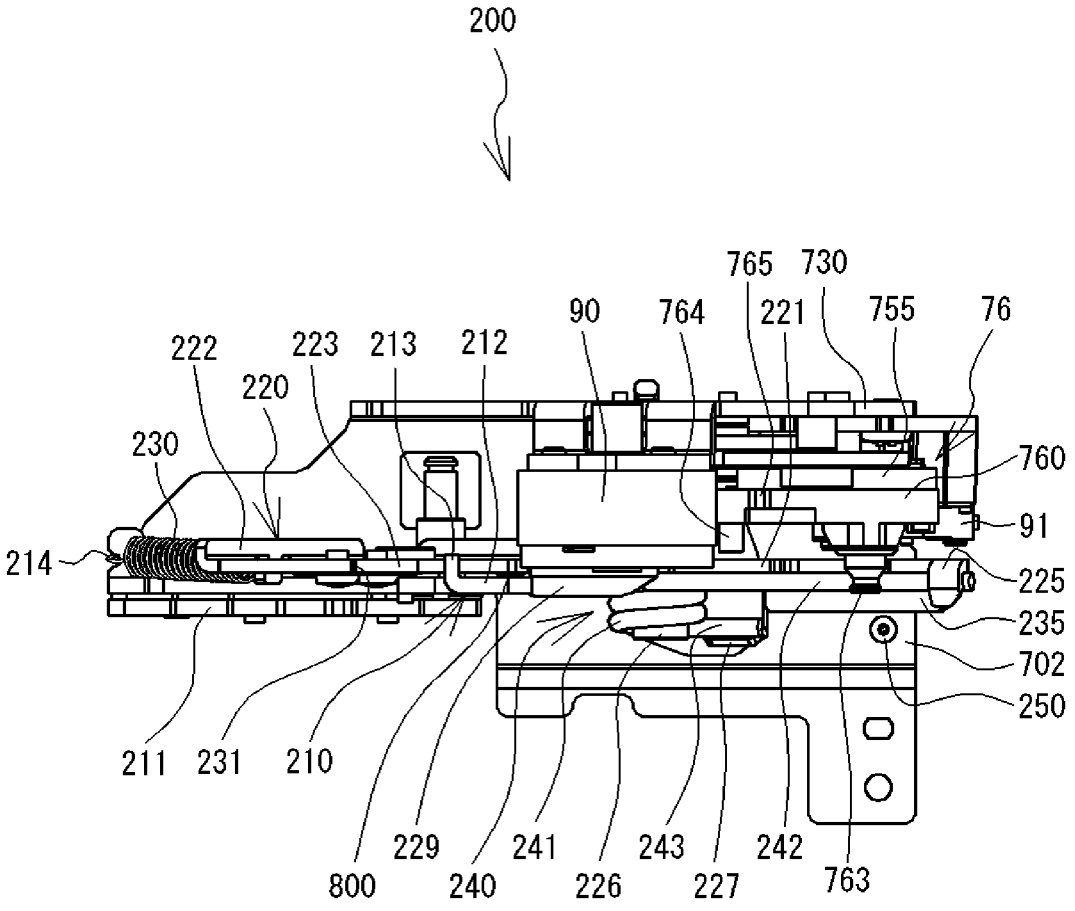
FIG. 7 is a plan view of the half-cut mechanism when the cam plate is in the reference rotation position.

As shown in FIG. 6 to FIG. 8, the fixed portion 210 is a plate-shaped member having a substantial L-shape in a rear view and includes a first plate portion 211, a second plate portion 212 and a receiving base 213. The first plate portion 211 is a plate-shaped portion that extends in the left-right direction and is fixed to the second frame 702. The second plate portion 212 is a plate-shaped portion that extends upward from the right end portion of the first plate portion 211. The receiving base 213 is configured to receive the tape arranged thereon. The receiving base 213 is a surface portion that is parallel to the front-rear direction and to the up-down direction and that protrudes to the rear from a left side portion of the second plate portion 212. The receiving base 213 is a rectangular shape that is long in the up-down direction and short in the front-rear direction.

The movable portion 220 is a plate-shaped member that has a substantial L-shape in a front view, and includes a first plate portion 221, a second plate portion 222 and a cutting blade 223 etc. The movable portion 220 is disposed such that it overlaps with the rear surface of the fixed portion 210 and such that it is positioned to the front of the cam plate 760. The first plate portion 221 is a plate-shaped portion that extends substantially in the left-right direction and extends from the rear surface side of the fixed portion 210 as far as the front surface side of the cam plate 760. The second plate portion 222 is a plate-shaped portion that extends upward from the left end portion of the first plate portion 221 such that it is inclined at a substantially 90 degree angle with respect to the first plate portion 221. The cutting blade 223 extends along a right side portion of the second plate portion 222 and is a blade portion that faces the receiving base 213 from the left side.

Note that a support hole (not shown in the drawings), which penetrates the movable portion 220, is provided in a portion that connects the first plate portion 221 and the second plate portion 222. A rotating shaft 201 of the fixed portion 210 extends to the rear from the portion that connects the first plate portion 221 and the second plate portion 222. The rotating shaft 201 is inserted into the support hole of the movable portion 220 and supports the movable portion 220 such that the movable portion 220 can rotate freely.

As shown in FIG. 9 and FIG. 10, latching plates 225 and 227, curved plate portions 229 and 235, a spring shaft portion 226, an escape groove 228 and a guide groove 233 are provided in the first plate portion 221. The spring shaft portion 226 is a circular column that extends to the front from the first plate portion 221, between the second plate portion 212 and the cam plate 760 in a front view. The latching plates 225 and 227 and the curved plate portions 229 and 235 are all protruding pieces that protrude to the front from the first plate portion 221.

The latching plate 225 protrudes to the front from an upper right end portion of the first plate portion 221. The latching plate 227 protrudes to the front from a lower right side of the spring shaft portion 226. The curved plate portion 229 protrudes to the front from the upper left side of the spring shaft portion 226 and the right side of the second plate portion 212. The curved plate portion 235 protrudes to the front from below the latching plate 225, and extends in a direction away from the spring shaft portion 226. The escape groove 228 is a groove portion that is recessed upward from a lower side portion of the first plate portion 221 and is provided between the second plate portion 212 and the spring shaft portion 226 in a front view.

As shown in FIG. 6 to FIG. 8, the regulating pin 250 is a shaft-shaped member that is provided in a standing manner on the second frame 702, to the front of the movable portion 220. The regulating pin 250 includes a circular column portion 251 and a tapered portion 252. The circular column portion 251 is a circular column that extends upward from the second frame 702. In a plan view, a peripheral surface of the circular column portion 251 is in close proximity to a front side portion of the curved plate portion 235. The tapered portion 252 is provided on the upper end portion of the circular column portion 251 and is a tapered shape whose diameter decreases toward the upward direction.

A gap forming portion 231 and a protruding portion 800 are provided on the second plate portion 222. The gap forming portion 231 protrudes from the upper side of the cutting blade 223 and protrudes slightly more toward the receiving base 213 than the cutting blade 223. The protruding portion 800 is provided on the second plate portion 222 in a position facing the fixed portion 210. The protruding portion 800 protrudes toward the fixed portion 210 and reduces a gap (so-called "backlash") between the movable portion 220 and the fixed portion 210.

As shown in FIG. 6 to FIG. 9, the compression spring 240 is a torsion coil spring that is held by the first plate portion 221 and includes a coil portion 241 and a pair of arm portions 242 and 243. The spring shaft portion 226 is inserted through a shaft hole of the coil portion 241. The pair of arm portions 242 and 243 extend respectively from both end portions of the coil portion 241 and extend to the outside in the radial direction of the coil portion 241. The pair of arm portions 242 and 243 are provided in mutually separated positions in the front-rear direction. The arm portion 242 that is on the rear side protrudes further from the coil portion 241 than the arm portion 243 that is on the front side. The leading end portion of the arm portion 242 is latched by the latching plate 225 due to the arm portion 242 urging the latching plate 225 from below. The leading end portion of the arm portion 243 is latched by the latching plate 227 due to the arm portion 243 urging the latching plate 227 from above.

The guide groove 233 is provided below the first drive pin 763 in a front view, and is a groove portion that is recessed downward from an upper side portion of the first plate portion 221. The guide groove 233 is recessed in an arc shape in a front view, to a position lower than the arm portion 242 that is latched by the latching plate 225.

One end portion of the extension spring 230 is connected to an attachment hole 224 that is provided in the second plate portion 222. The other end of the extension spring 230 is connected to an attachment hole 214 that is provided in a left end portion of the first plate portion 211. The second plate portion 222 is urged to the left by an elastic force of the extension spring 230. In a state in which an external force is not applied to the movable portion 220, the movable portion 220 rotates around the rotating shaft 201 in the counter-clockwise direction in a front view. When the curved plate portion 229 comes into contact with the second plate portion 212, the rotation of the movable portion 220 is regulated. In this way, the movable portion 220 is held in a first retracted position in which the cutting blade 223 is separated from the receiving base 213.

Detailed Structure of Full-Cut Mechanism 300

The full-cut mechanism 300 will be explained with reference to FIG. 11 and FIG. 12. The full-cut mechanism 300 is a mechanism that is configured to cut all the layers of the tape in which the plurality of layers are laminated. The full-cut mechanism 300 includes a fixed portion 310, a movable portion 320 and an extension spring 330 (refer to FIG. 5).

The fixed portion 310 is a plate-shaped member having a substantial L-shape in a rear view, and includes a first plate portion 311, a second plate portion 312 and a fixed blade 314. The first plate portion 311 is a plate-shaped portion that extends in the left-right direction and is fixed to the second frame 702 (refer to FIG. 5). The second plate portion 312 is a plate-shaped portion that extends upward from a right end portion of the first plate portion 311. The fixed blade 314 is a blade portion that is provided on a left side portion of the second plate portion 312 and extends in the up-down direction.

The movable portion 320 is a plate-shaped member that has a substantial L-shape in a front view, and includes a first plate portion 321, a second plate portion 322 and a movable blade 324 etc. The movable portion 320 is disposed such that it overlaps with the rear surface of the fixed portion 310 and such that it is positioned to the front of the cam plate 760. The first plate portion 321 is a plate-shaped portion that extends substantially in the left-right direction and extends from the rear surface side of the fixed portion 310 as far as the front surface side of the cam plate 760. The second plate portion 322 is a plate-shaped portion that extends upward from the left end portion of the first plate portion 321 such that it is inclined at a substantially 90 degree angle with respect to the first plate portion 321. The movable blade 324 extends along a right side portion of the second plate portion 322 and is a blade portion that faces the fixed blade 314 from the left side.

A support hole (not shown in the drawings), which penetrates the fixed portion 310, is provided in a portion that connects the first plate portion 311 and the second plate portion 312. A support hole (not shown in the drawings), which penetrates the movable portion 320, is provided in a portion that connects the first plate portion 321 and the second plate portion 322. A rotating shaft 301, which extends in the front-rear direction, is inserted through each of the support holes of the fixed portion 310 and the movable portion 320. The rotating shaft 301 supports the fixed portion 310 and the movable portion 320 in a state in which they overlap with each other.

A guide groove 323, a guide hole 325 and an escape groove 328 are provided in the first plate portion 321. The guide groove 323 is a groove portion that is recessed downward from an upper side portion of the first plate portion 321 and is provided on the leading end side of the first plate portion 321. The guide hole 325 is a hole that penetrates the first plate portion 321 and is provided substantially in the center, in a lengthwise direction, of the first plate portion 321. The guide hole 325 is a long hole that extends substantially in parallel to the lengthwise direction of the first plate portion 321. The vicinity of the left end portion of the first plate portion 321 is tilted forward toward the rear surface of the fixed portion 310

(refer to FIG. 11), and the escape groove 328 is also provided in the vicinity of the left end portion. The escape groove 328 is a groove portion that is recessed downward from an upper side portion of the first plate portion 321.

One end portion of the extension spring 330 (refer to FIG. 5) is connected to an attachment hole 313 that is provided in a left end portion of the first plate portion 311. The other end of the extension spring 330 is connected to an attachment hole 329 that is provided in the second plate portion 322. The second plate portion 322 is urged to the left by an elastic force of the extension spring 330. In a state in which an external force is not applied to the movable portion 320, the movable portion 320 rotates around the rotating shaft 301 in the counter-clockwise direction in a front view. In this way, the movable portion 320 is held in a second retracted position in which the movable blade 324 is separated from the fixed blade 314.

Detailed Structure of Feed Mechanism 400

The feed mechanism 400 will be explained with reference to FIG. 11, FIG. 12 and FIG. 19. The feed mechanism 400 is a mechanism that is configured to feed the tape, which has been cut by the full-cut mechanism 300, toward the discharge port 111 (refer to FIG. 1). The feed mechanism 400 includes a first link 410, a second link 420, a movable roller 430 and a fixed roller 440 etc.

A guide member 770 (refer to FIG. 3 and FIG. 4) is provided in the tape discharge portion 110 (refer to FIG. 1) along the tape feed path. The guide member 770 is provided on the fixed portion 210 (refer to FIG. 9). The guide member 770 has a guide surface that guides the printed tape, which is being fed by the tape discharge portion 110, toward the discharge port 111.

The fixed roller 440 is provided on the guide member 770 and is a rotating body that can rotate around an axis that extends in the up-down direction. The fixed roller 440 is provided to the rear of the fixed blade 314. A rotating shaft 401 is provided below the fixed roller 440. The rotating shaft 401 is a shaft portion that is provided on the guide member 770 and extends in the front-rear direction. The rotating shaft 401 axially supports the first link 410 and the second link 420 such that they are aligned in the front-rear direction.

The first link 410 is a plate-shaped member that is long substantially in the left-right direction and that is disposed to the rear of the movable portion 320. The first link 410 can rotate around the rotating shaft 401 to the front of the second link 420. The first link 410 extends upward and to the right from the rotating shaft 401 as far as the rear side of the guide hole 325, and extends upward and to the left from the rotating shaft 401 as far as the left side of the fixed roller 440. A latching pin 411, which protrudes to the front from the first link 410, is provided on the right end portion of the first link 410. The latching pin 411 is inserted into the guide hole 325. An operating mechanism 412, which causes the movable roller 430 to rotate, is provided on the upper left end portion of the first link 410.

The second link 420 is a plate-shaped member that can rotate around the rotating shaft 401 to the rear of the first link 410, and extends upward and to the left from the rotating shaft 401. The second link 420 is connected to the first link 410 via a connecting spring 402 that is provided on the rotating shaft 401. A roller holder 414, which rotatably supports the movable roller 430, is provided on an upper left end portion of the second link 420. The roller holder 414 is disposed to the right of the operating mechanism 412. The movable roller 430 faces the fixed roller 440 from the left side.

Structures and effects of the operating mechanism 412 and the roller holder 414 are known, as disclosed in Japanese Laid-Open Patent Publication No. 2000-71523, for example, and a brief explanation thereof will be given here. The roller holder 414 has a spring (not shown in the drawings) that urges the movable roller 430 to the right. The operating mechanism 412 has a roller pressing member 412A, a hook member 412B, a spring 412C and the like (refer to FIG. 12).

The roller pressing member 412A is a movable body that is disposed to the front of the movable roller 430 and that can move in the substantially left-right direction. The spring 412C urges the roller pressing member 412A toward the movable roller 430. Due to the elastic force of the spring 412C, the roller pressing member 412A presses a first protruding portion (not shown in the drawings) that is provided on the movable roller 430. The hook member 412B is disposed to the rear of the movable roller 430 and is in contact with a second protruding portion (not shown in the drawings) that is provided on the movable roller 430.

In accordance with the rotation of the movable portion 320 of the full-cut mechanism 300, the latching pin 411 moves along the guide hole 325. The first link 410 rotates around the rotating shaft 401 in accordance with the movement of the latching pin 411. The second link 420 rotates, via the connecting spring 402, in accordance with the rotation of the first link 410. As shown in FIG. 11 and FIG. 12, when the movable portion 320 moves toward the second retracted position, the latching pin 411 moves toward the left end portion of the guide hole 325. The first link 410 and the second link 420 rotate in the counter-clockwise direction in a front view. In this manner, the second link 420 is held in a third retracted position in which the movable roller 430 is separated from the fixed roller 440.

Connecting Structure of Cutting Mechanism 80

A connecting structure of the cutting mechanism 80 will be explained with reference to FIG. 5 and FIG. 9 to FIG. 12. As shown in FIG. 5, the movable portion 220 of the half-cut mechanism 200 extends in the left-right direction, straddling the movable portion 320 of the full-cut mechanism 300. The escape groove 228 (refer to FIG. 9) of the half-cut mechanism 200 faces the escape groove 328 (refer to FIG. 11) of the full-cut mechanism 300, from above.

As shown in FIG. 5, FIG. 10 and FIG. 12, on a left side portion of the cutting mechanism 800, the fixed blade 314 of the full-cut mechanism 300, the receiving base 213 of the half-cut mechanism 200 and the fixed roller 440 of the feed mechanism 400 are aligned in the above order from the front to the rear. The movable blade 324 of the full-cut mechanism 300, the cutting blade 223 of the half-cut mechanism 200 and the movable roller 430 of the feed mechanism 400 are aligned from the front to the rear. On a right side portion of the cutting mechanism 800, the first plate portion 221 of the half-cut mechanism 200 is arranged to the front of the first plate portion 321 of the full-cut mechanism 300. The first plate portion 221 extends further to the right than the first plate portion 321. The latching pin 411 of the feed mechanism 400 is connected to the guide hole 325 (refer to FIG. 11) of the full-cut mechanism 300 at a position further to the left than the drive cam 76.

When the cutter drive motor 90 is not being driven, the cutting mechanism 80 is in a stand-by state (refer to FIG. 5 to FIG. 12). When the cutting mechanism 80 is in the stand-by state, the movable portions 220 and 320 and the second link 420 are in the first to third retracted positions, respectively. A gap between the fixed blade 314 and the movable blade 324, a gap between the receiving base 213 and the cutting blade 223 and a gap between the fixed roller 440 and the movable roller 430 communicate with each other in the front-rear direction. The tape feed path in the tape discharge portion 110

(refer to FIG. 1) passes through the gaps that communicate with each other in the front-rear direction. The printed tape is fed along the fixed blade 314, the receiving base 213 and the fixed roller 440.

When the cutting mechanism 80 is in the stand-by state, a rotation position of the cam plate 760 is a reference rotation position, in which the protruding portion 762 faces the left side. In this case, as shown in FIG. 6 to FIG. 10, the first drive pin 763 extends to the front to a position above the first plate portion 221 of the half-cut mechanism 200, above the shaft portion 761. The first drive pin 763 comes into contact, from above, with the arm portion 242 of the compression spring 240 that is latched by the latching plate 225. As shown in FIG. 11 and FIG. 12, the second drive pin 764 extends to the front to a position above the first plate portion 321 of the full-cut mechanism 300, to the left of the shaft portion 761. The second drive pin 764 comes into contact, from above, with the guide groove 323 of the first plate portion 321.

Operational Modes of Cutting Mechanism 80

Operational modes of the cutting mechanism 80 will be explained with reference to FIG. 5 to FIG. 19. The cutting mechanism 80 starts a cutting operation of the printed tape from the stand-by state (refer to FIG. 5 to FIG. 12). Specifically, when the cutting operation starts, the cam plate 760 is in the reference rotation position. The movable pins 91A and 92A are both in the steady state and thus the detection sensors 91 and 92 are both in the OFF state (refer to FIG. 11).

Operational Modes of Half-Cut Mechanism 200

Operational modes of the half-cut mechanism 200 will be explained. When the control portion 20 (refer to FIG. 3) causes the half-cut mechanism 200 (refer to FIG. 9) to cut the printed tape, the control portion 20 causes the cutter drive motor 90 to rotate in the forward direction (hereinafter sometimes referred to as forward rotation). During the forward rotation of the cutter drive motor 90, the cam plate 760 rotates in the clockwise direction in a front view (refer to FIG. 16) via the gears 751 to 755 (refer to FIG. 3 to FIG. 5). In accordance with the rotation of the cam plate 760, the first drive pin 763 rotates in a first operating direction around the shaft portion 761. The first operating direction of the present embodiment is the clockwise direction in a front view.

Figure 13:
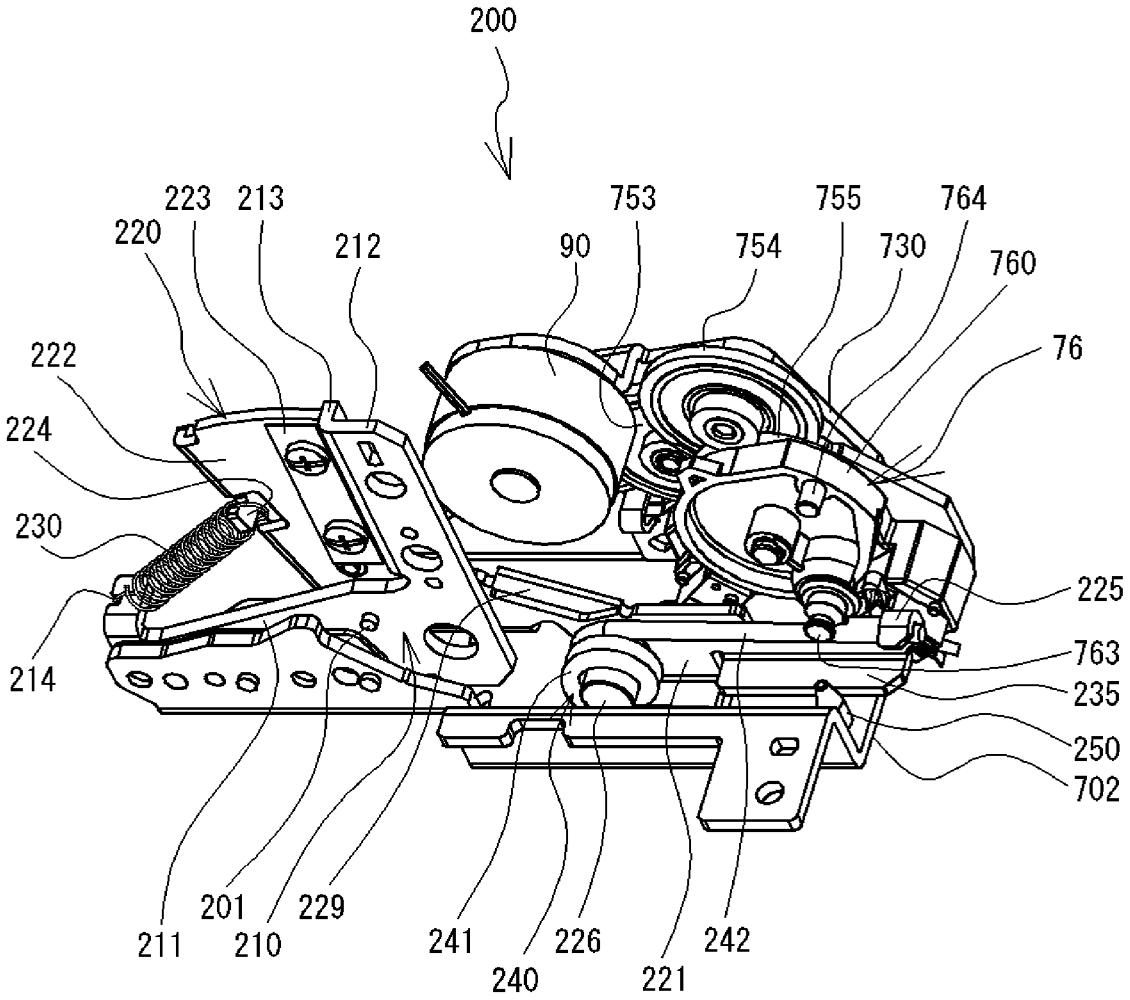
FIG. 13 is a perspective view of the half-cut mechanism when the cam plate is in a first rotation position.
Figure 14:
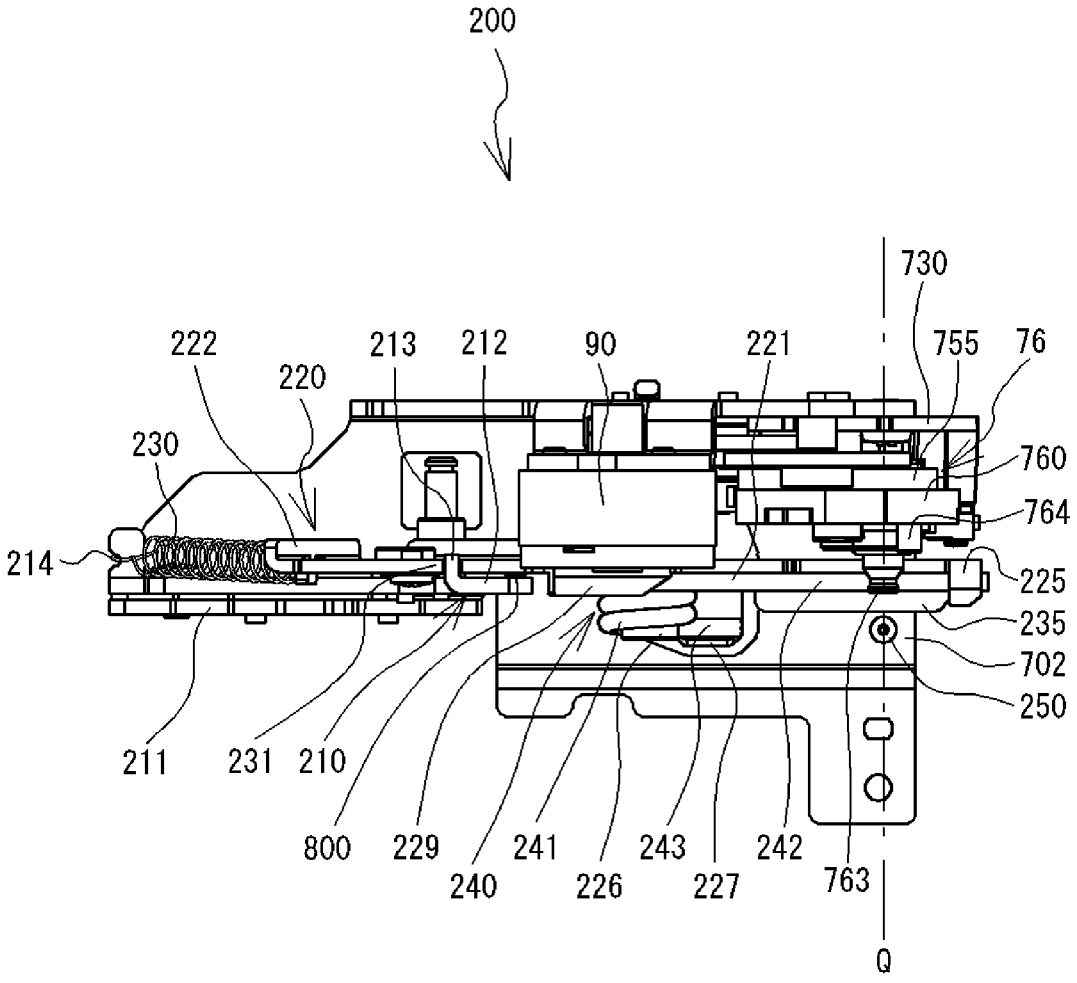
FIG. 14 is a plan view of the half-cut mechanism when the cam plate is in the first rotation position.
Figure 15:
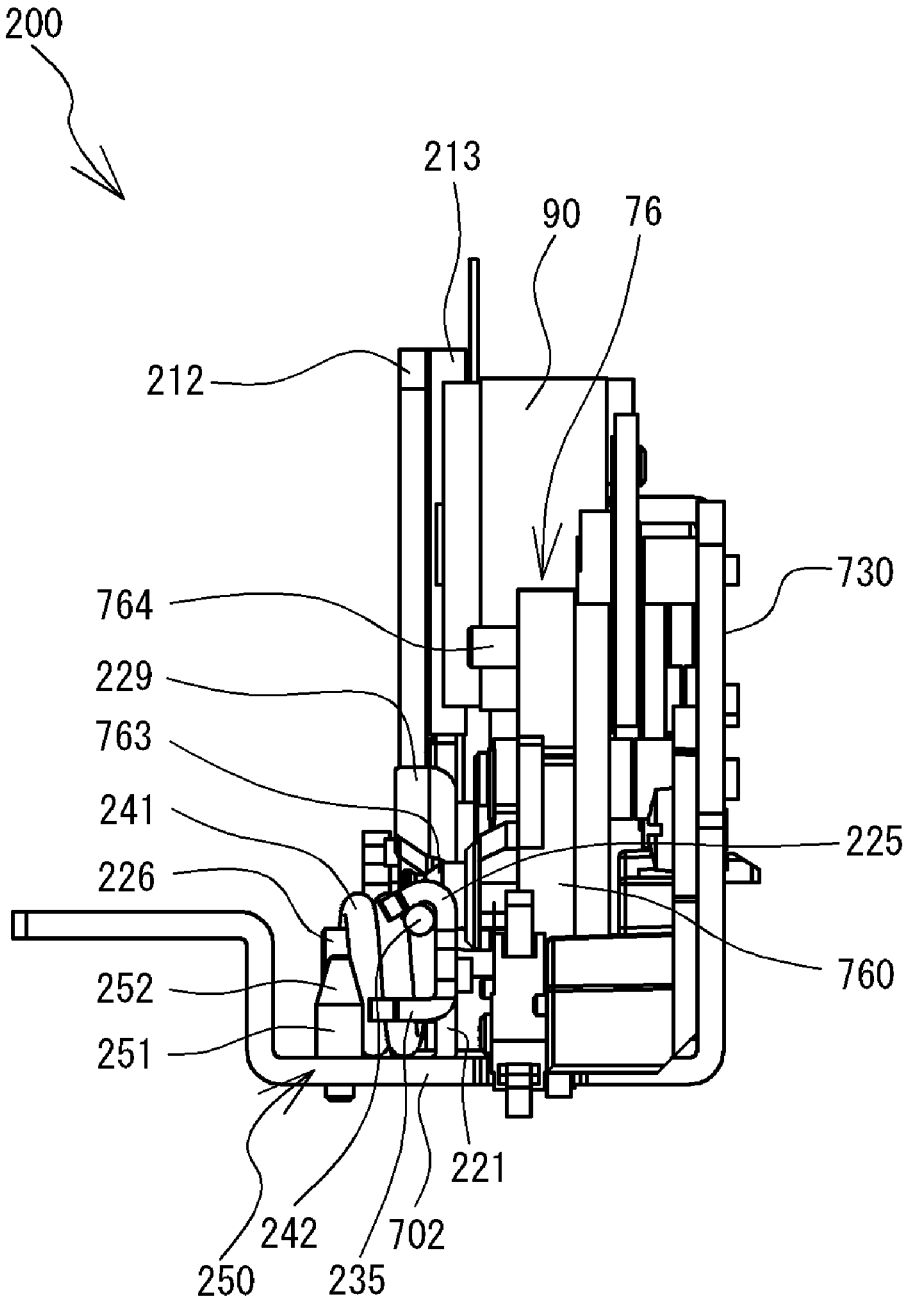
FIG. 15 is a right side view of the half-cut mechanism when the cam plate is in the first rotation position.

As shown in FIG. 13 to FIG. 15, the first drive pin 763 that rotates in the first operating direction urges the arm portion 242 downward. In response to the external force that is exerted on the arm portion 242, the arm portion 243 urges the latching plate 227 downward. The movable portion 220 resists the elastic force of the extension spring 230 and rotates in the first operating direction around the rotating shaft 201. The cutting blade 223 that is provided on the second plate portion 222 moves to the right. Specifically, the arm portion 242 functions as a point of effort that receives the external force which causes the movable portion 220 to rotate. The arm portion 243 functions as a point of action that urges the movable portion 220 in accordance with the external force received by the arm portion 242.

When the movable portion 220 rotates in the first operating direction from the reference rotation position, as described above, the escape groove 228 (refer to FIG. 9) of the first plate portion 221 fits into the escape groove 328 (refer to FIG. 11) of the first plate portion 321. As a result, the half-cut mechanism 200 can perform the cutting operation without any interference with the full-cut mechanism 300.

As shown in FIG. 13 to FIG. 15, when the cam plate 760 rotates by approximately 90 degrees in the first operating direction from the reference rotation position, the movable portion 220 moves from the first retracted position (refer to FIG. 9) to a first cutting position. The first cutting position is a position in which the cutting blade 223 is in close proximity to the receiving base 213. When the movable portion 220 is in the first cutting position, the gap forming portion 231 comes into contact with the receiving base 213, and the rotation of the movable portion 220 in the first operating direction is regulated. A gap that is narrower than the thickness of the printed tape (a gap that is substantially equal to the thickness of the release layer, for example) is formed between the cutting blade 223 and the receiving base 213. A rotation position of the cam plate 760 that causes the movable portion 220 to move to the first cutting position is referred to as a first rotation position.

When the movable portion 220 moves from the first retracted position to the first cutting position, the curved plate portion 235 passes to the rear of the regulating pin 250 and moves downward. At this time, due to the gap (namely, the backlash) between the fixed portion 210 and the movable portion 220, the movable portion 220 may tilt from a correct posture. In this case, the curved plate portion 235 comes into contact with the tapered portion 252 and is guided toward the circular column portion 251 along the inclined surface of the tapered portion 252. In this way, since the movable portion 220 rotates to the cutting position in the correct posture, the cutting blade 223 vertically approaches the receiving base 213.

Figure 16:
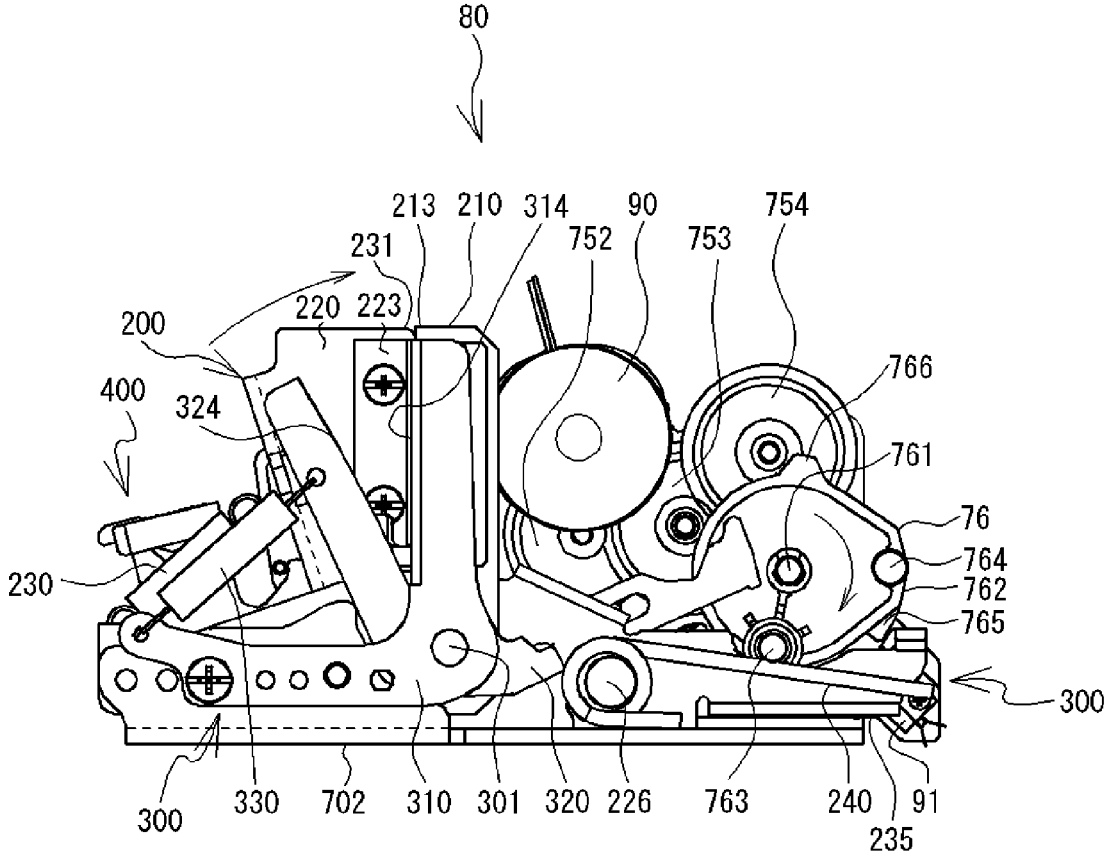
FIG. 16 is a front view of the cutting device in a state when the cam plate is rotating in a first operating direction.

As shown in FIG. 16, in accordance with the further rotation of the cam plate 760 in the first operating direction from the first rotation position, the first drive pin 763 urges the arm portion 242 downward. The rotation of the movable portion 220 in the first operating direction is regulated and thus the compression spring 240 is elastically deformed by the urging force applied to the arm portion 242 by the first drive pin 763. The arm portion 242 bends downward and separates away from the latching plate 225.

In the present embodiment, the point of effort (the arm portion 242) and the point of action (the arm portion 243) of the compression spring 240 are in mutually different positions in the front-rear direction (refer to FIG. 13 to FIG. 15). The compression spring 240 that is elastically deformed in the manner described above generates an urging force, which includes a vector component that is different to the first operating direction. For example, the vector component that is different to the first operating direction acts in a direction from the arm portion 242 toward the arm portion 243 (to the front and downward in the present embodiment). Due to the vector component, it is possible that the movable portion 220 that is in the first cutting position may move in the forward direction along the spring shaft portion 226. In other words, it is possible that the posture and the position of the cutting blade 223 that is positioned in close proximity to the receiving base 213 may change.

When the movable portion 220 is in the first cutting position (refer to FIG. 13 to FIG. 15), the circular column portion 251 of the regulating pin 250 is facing the curved plate portion 235. If the movable portion 220 is urged to the forward direction due to the elastic deformation of the compression spring 240, the curved plate portion 235 comes into contact with the circular column portion 251 and thus the movement of the movable portion 220 in the forward direction is regulated. As a result, even if the elastic deformation of the compression spring 240 occurs, the correct posture and position of the cutting blade 223 that is positioned in close proximity to the receiving base 213 are maintained.

A distance from the rotating shaft 201 to the first drive pin 763 is substantially equal to a distance from the rotating shaft 201 to the regulating pin 250. When the movable portion 220 is in the first cutting position, the first drive pin 763 and the regulating pin 250 are aligned in the front-rear direction in a plan view (refer to a line Q shown in FIG. 14). In other words, the regulating pin 250 faces the front side of the first drive pin 763 that presses the arm portion 242. In this way, the regulating pin 250 can reliably regulate the forward movement of the movable portion 220 on the side of the vector direction that causes the movable portion 220 to move in the forward direction.

Figure 17:
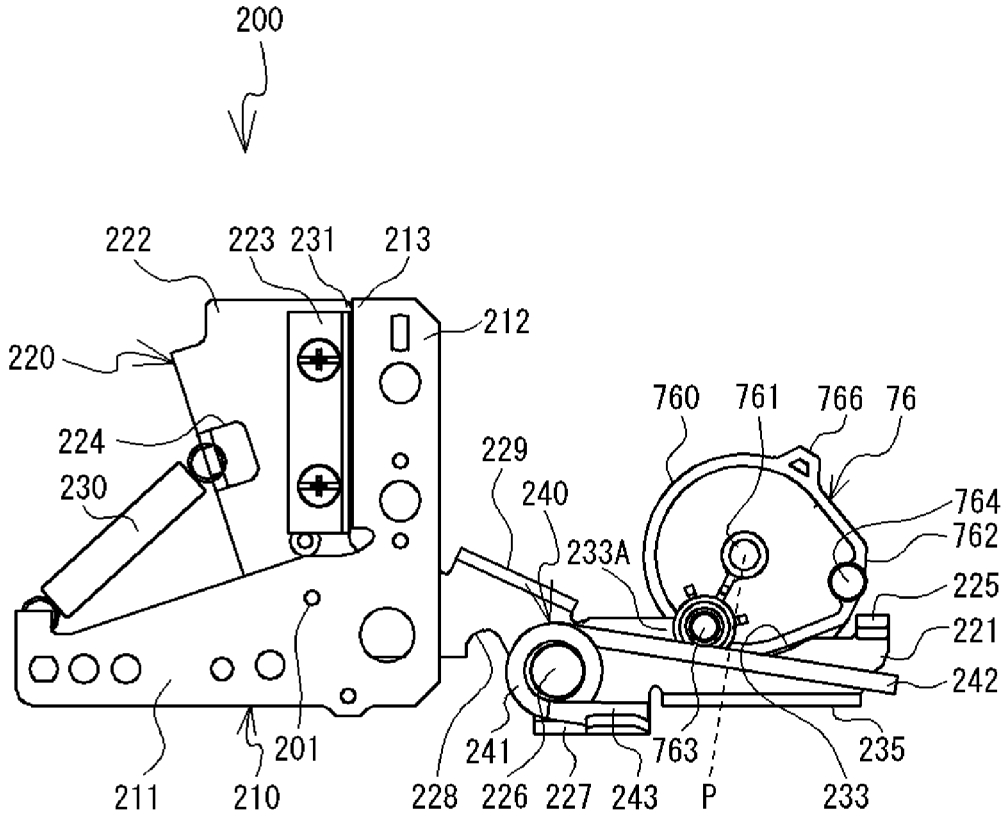
FIG. 17 is a front view of the half-cut mechanism when the cam plate is in a second rotation position.

Next, as shown in FIG. 17, the first drive pin 763 that rotates in the first operating direction slides from the right end portion to the left end portion of the guide groove 233, while bending the arm portion 242 downward. A rotation position of the cam plate 760 that causes the first drive pin 763 to slide to the left end portion of the guide groove 233 is referred to as a second rotation position. When the cam plate 760 has rotated to the second rotation position, the first drive pin 763 comes into contact with a wall portion 233A that forms the left end portion of the guide groove 233. Specifically, the wall portion 233A comes into contact with the first drive pin 763 from an opposite side to the first operating direction in which the first drive pin 763 is rotating, and thus regulates the sliding of the first drive pin 763.

In accordance with the cam plate 760 rotating in the first operating direction from the reference rotation position (refer to FIG. 9), as described above, the movable pin 91A (refer to FIG. 11) moves relative to the cam plate 760 along the front peripheral surface 760A (refer to FIG. 10). When the cam plate 760 rotates as far as the second rotation position (refer to FIG. 17), the protruding portion 762 presses the movable pin 91A. The movable pin 91A changes from the steady state to the tilted state and thus the detection sensor 91 (refer to FIG. 11) changes from the OFF state to the ON state.

Meanwhile, when the cam plate 760 that is rotating in the first operating direction moves from the reference rotation position to the second rotation position, the movable pin 92A (refer to FIG. 11) passes to the rear of the second detection plate 766 and moves relative to the cam plate 760 along the rear peripheral surface 760B (refer to FIG. 10). Since the movable pin 92A is not pressed, the detection sensor 92 (refer to FIG. 11) remains in the OFF state.

Therefore, when the detection sensor 91 is in the ON state and the detection sensor 92 is in the OFF state during the forward rotation of the cutter drive motor 90, the control portion 20 determines that the cam plate 760 has rotated as far as the second rotation position. When the cam plate 760 has rotated as far as the second rotation position, the control portion 20 stops the driving of the cutter drive motor 90 for a predetermined time period.

When the cam plate 760 is in the second rotation position, a direction in which the urging force of the arm portion 242 acts on the first drive pin 763 is substantially parallel to a vertical line P (refer to FIG. 17), that extends taking the a shortest distance from the arm portion 242 to the shaft portion 761. The first drive pin 763 that is in contact with the wall portion 233A is positioned further in the first operating direction than the vertical line P. As a result, due to the urging force of the arm portion 242, the first drive pin 763 is urged to rotate in the first operating direction.

In contrast to this, the rotation of the first drive pin 763 in the first operating direction is regulated by the wall portion 233A. As a result, due to the arm portion 242 urging the first drive pin 763 against the wall portion 233A, the movement of the first drive pin 763 (namely, the rotation of the cam plate 760) is regulated. Even if the driving of the cutter drive motor 90 is stopped, the state in which the cutting blade 223 is in close proximity to the receiving base 213 is maintained.

Due to the above-described operations, the printed tape is cut in the following manner. In accordance with the cam plate 760 rotating from the reference rotation position (refer to FIG. 9) to the first rotation position (refer to FIG. 13 to FIG. 15) in the first operating direction, the cutting blade 223 approaches the receiving base 213. The printed tape that has been fed to the tape discharge portion 110 (refer to FIG. 1) is pressed against the receiving base 213 by the cutting blade 223, and is arranged in the gap between the cutting blade 223 and the receiving base 213. While the cam plate 760 rotates from the first rotation position to the second rotation position (refer to FIG. 17), and while the cam plate 760 is held in the second rotation position, the cutting blade 223 strongly urges the printed tape toward the receiving base 213. Part of the layers of the printed tape is cut by the cutting blade 223.

After that, the control portion 20 causes the cutter drive motor 90 to rotate in the reverse direction (hereinafter sometimes referred to as reverse rotation). The control portion 20 causes the cutter drive motor 90 to rotate in the reverse direction by a predetermined amount until the cam plate 760 has rotated from the second rotation position (refer to FIG. 17) to the reference rotation position (refer to FIG. 9). When the cutter drive motor 90 rotates in the reverse direction, the cam plate 760 rotates in the counter-clockwise direction in a front view, via the gears 751 to 755. In accordance with the rotation of the cam plate 760, the first drive pin 763 rotates in the second operating direction around the shaft portion 761. The second operating direction of the present embodiment is the counter-clockwise direction in a front view.

In accordance with the cam plate 760 rotating from the second rotation position to the first rotation position (refer to FIG. 13 to FIG. 15), the first drive pin 763 slides from the left end portion to the right end portion of the guide groove 233. The arm portion 242 moves elastically such that it lifts up the first drive pin 763, and is latched by the latching plate 225. In accordance with the cam plate 760 rotating further from the first rotation position to the reference rotation position, the movable portion 220 rotates in the second operating direction around the rotating shaft 201 due to the elastic force of the extension spring 230. The cutting blade 223 that is provided on the second plate portion 222 moves to the left. The movable portion 220 moves from the first cutting position (refer to FIG. 13 to FIG. 15) to the first retracted position (refer to FIG. 9).

As a result of the above-described operations, the cutting mechanism 80 returns to the stand-by state. After that, the control portion 20 drives the tape drive motor 711 (refer to FIG. 4) by a predetermined amount. In this way, the printed tape of which part of the layers has been cut is fed toward the discharge port 111 (refer to FIG. 1).

Operational Modes of Full-Cut Mechanism 300 and Feed Mechanism 400

Operational modes of the full-cut mechanism 300 and the feed mechanism 400 will be explained. When the control portion 20 causes the full-cut mechanism 300 (refer to FIG. 11) to cut the printed tape, the control portion 20 rotates the cutter drive motor 90 in the reverse direction and rotates the cam plate 760 in the second operating direction from the reference rotation position.

Figure 18:
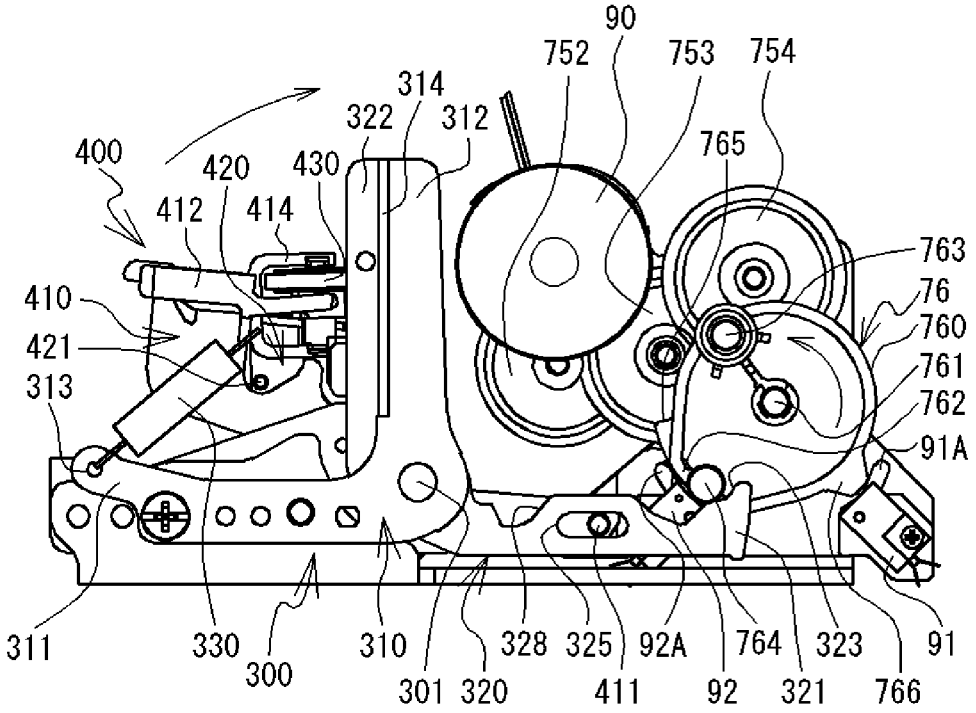
FIG. 18 is a front view of the full-cut mechanism and the feed mechanism when the cam plate is in a third rotation position.
Figure 19:
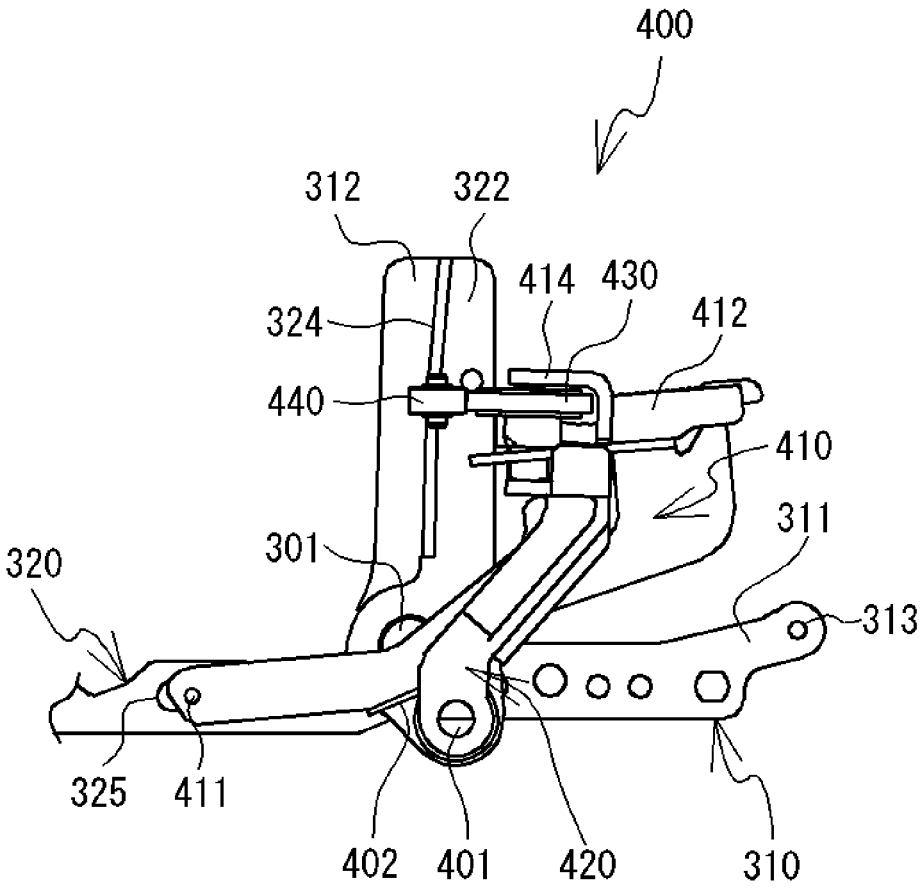
FIG. 19 is a back view of the feed mechanism.

As shown in FIG. 18 and FIG. 19, the second drive pin 764 that rotates in the second operating direction urges the first plate portion 321 downward in the guide groove 323. In accordance with the downward movement of the first plate portion 321, the movable portion 320 resists the elastic force of the extension spring 330 and rotates in the first operating direction around the rotating shaft 301. When the cam plate 760 rotates approximately 45 degrees in the second operating direction from the reference rotation position, the movable portion 320 moves from the second retracted position to a second cutting position. The second cutting position is a position at which the movable blade 324 intersects with the fixed blade 314. A rotation position of the cam plate 760 that causes the movable portion 320 to move to the second cutting position is referred to as a third rotation position.

In accordance with the rotation of the cam plate 760 in the second operating direction from the reference rotation position, as described above, the movable pin 92A that moves relative to the cam plate 760 along the rear peripheral surface 760B (refer to FIG. 10) is pressed by the first detection plate 765. The movable pin 92A changes from the steady state to the tilted state and thus the detection sensor 92 changes from the OFF state to the ON state.

Meanwhile, when the cam plate 760 that rotates in the second operating direction from the reference rotation position reaches the third rotation position, the movable pin 91A that moves relative to the cam plate 760 along the front peripheral surface 760A (refer to FIG. 10) is pressed by the second detection plate 766. As the movable pin 91A changes from the steady state to the tilted state, the detection sensor 91 changes from the OFF state to the ON state.

Thus, during the reverse rotation of the cutter drive motor 90, when both the detection sensors 91 and 92 are in the ON state, the control portion 20 determines that the cam plate 760 has rotated to the third rotation position and stops the driving of the cutter drive motor 90.

Further, in accordance with the rotation of the cam plate 760 in the second operating direction from the reference rotation position, the latching pin 411 of the first link 410 moves toward the right end portion of the guide hole 325. In accordance with the movement of the latching pin 411, the first link 410 rotates in the first operating direction around the rotating shaft 401. The second link 420 also rotates in concert with the first link 410, via the connecting spring 402.

In this way, the second link 420 moves from the third retracted position (refer to FIG. 11) to a feed position. The feed position is a position at which the movable roller 430 is urged by the fixed roller 440 via the printed tape. Further, in accordance with the rotation of the first link 410, the roller pressing member 412A (refer to FIG. 12) of the operating mechanism 412 urges the first protruding portion (not shown in the drawings) of the movable roller 430 due to the elastic force of the spring 412C (refer to FIG. 12). In this way, the movable roller 430 rotates by a half rotation while urging the printed tape against the fixed roller 440.

As a result of the above-described operation, the printed tape is cut in the following manner. In accordance with the cam plate 760 rotating in the second operating direction from the reference rotation position (refer to FIG. 11) to the third rotation position (refer to FIG. 18), the printed tape that has been fed to the tape discharge portion 110 (refer to FIG. 1) is pressed against the fixed roller 440 by the movable roller 430. All the layers of the printed tape are cut between the cutting blade 324 and the fixed blade 314. The operating mechanism 412 that is coming into close proximity to the movable roller 430 causes the movable roller 430 to rotate by a half rotation using the roller pressing member 412A. The cut printed tape is fed toward the discharge port 111 (refer to FIG. 1) by a distance that corresponds to the half rotation of the movable roller 430.

After that, the control portion 20 rotates the cutter drive motor 90 in the forward direction by a predetermined amount, until the cam plate 760 rotates from the third rotation position to the reference rotation position. In this way, the second drive pin 764 rotates in the first operating direction. Due to the elastic force of the extension spring 330, the movable portion 320 rotates in the second operating direction around the rotating shaft 301. The movable portion 320 moves from the second cutting position (refer to FIG. 18 and FIG. 19) to the second retracted position (refer to FIG. 11).

Further, in accordance with the rotation of the movable portion 320, the latching pin 411 moves toward the left end portion of the guide hole 325. The first link 410 and the second link 420 rotate in the second operating direction around the rotating shaft 401. The second link 420 moves from the feed position (refer to FIG. 18 and FIG. 19) to the third retracted position (refer to FIG. 11). In accordance with the rotation of the first link 410, the hook member 412B (refer to FIG. 12) of the operating mechanism 412 urges the second protruding portion (not shown in the drawings) of the movable roller 430. In this way, before the movable roller 430 separates from the fixed roller 440, the movable roller 430 rotates by a half rotation while urging the printed tape against the fixed roller 440. The cut printed tape is fed toward the discharge port 111 by the distance that corresponds to the half rotation of the movable roller 430.

As a result of the above-described operation, the cutting mechanism 80 returns to the stand-by state. As described above, the operating mechanism 412 performs the half rotation of the movable roller 430 twice (that is, performs one full rotation) and thus the printed tape of which all the layers have been cut is fed toward the discharge port 111.

Examples of Operational Effects of Present Embodiment (1) When the first drive pin 763 rotates in the first operating direction in accordance with the forward rotation of the cutter drive motor 90, the movable portion 220 moves toward the first cutting position. When the first drive pin 763 rotates in the second operating direction in accordance with the reverse rotation of the cutter drive motor 90, the movable portion 220 moves toward the first retracted position. When the movable portion 220 reaches the first cutting position, the rotation of the cutter drive motor 90 is stopped. The position of the first drive pin 763 is maintained by the compression spring 240. When the movable portion 220 reaches the first cutting position, the cutting blade 223 is in close proximity to the receiving base 213. A gap that is substantially the same as the thickness of part of the layers of the tape is formed between the cutting blade 223 and the receiving base 213 by the gap forming portion 231.

In this manner, part of the layers of the tape is cut (namely, a half cut operation is performed) to the same thickness as the gap formed between the cutting blade 223 and the receiving base 213. When the movable portion 220 moves as far as the first cutting position, the position of the first drive pin 763 is maintained. Even though the rotation of the cutter drive motor 90 is stopped, the state of the cutting blade 223 in close proximity to the receiving base 213 is maintained. Thus, the tape is reliably half cut without continuing the rotation of the cutter drive motor 90. It is thus possible to suppress the amount of power consumption necessary to half cut the tape.

(2) When the second drive pin 764 moves in the second operating direction in accordance with the reverse rotation of the cutter drive motor 90, the movable portion 320 moves toward the second cutting position. When the second drive pin 764 moves in the first operating direction in accordance with the forward rotation of the cutter drive motor 90, the movable portion 320 moves toward the second retracted position. When the movable portion 320 reaches the second cutting position, the movable blade 324 intersects with the fixed blade 314. The movable blade 324 that intersects the fixed blade 314 cuts all the layers of the tape (namely, a full cut operation is performed). Thus, by simply changing the rotation direction of the single cutter drive motor 90, full cutting and half cutting of the tape may be selectively performed.

(3) The operating mechanism 412 rotates the movable roller 430 in accordance with the movable portion 320 moving toward or away from the second cutting position. The tape that is cut between the fixed blade 314 and the movable blade 324 is fed in a specific direction by the rotated movable roller 430. Thus, simply by controlling the rotation of the single cutter drive motor 90, it is possible to not only perform the full cutting of the tape, but also to perform feeding of the full cut tape.

(4) When the cam plate 760 moves to the second rotation position, the movable portion 220 moves to the first cutting position. When the cam plate 760 moves to the third rotation position, the movable portion 320 moves to the second cutting position. When it is detected that the cam plate 760 is in either the second or the third rotation position, the rotation of the cutter drive motor 90 is stopped. Thus, by the common detection sensors 91 and 92 detecting the cam plate 760, the half cut operation or the full cut operation that is being performed may be stopped and controlled.

(5) In accordance with the first drive pin 763 moving in the first operating direction, the movable portion 220 moves toward the first cutting position due to the pressing force of the compression spring 240. In accordance with the first drive pin 763 moving in the second operating direction, the movable portion 220 moves toward the first retracted position due to the urging force of the extension spring 230. When the movable portion 220 reaches the first cutting position, the first drive pin 763 that comes into contact with the wall portion 233A is urged toward the wall portion 233A by the compression spring 240. The position of the first drive pin 763 that comes into contact with the wall portion 233A is maintained by the elastic force of the compression spring 240. Thus, it is possible to maintain the position of the cam plate 760 using an elastic member having a simple structure, and it is possible to suppress the amount of power consumption necessary to half cut the tape.

(6) The movable portion 220 that has the cutting blade 223 is configured to rotate around the rotating shaft 201 such that the cutting blade 223 comes into close proximity to or moves away from the receiving base 213. The compression spring 240 that is provided on the movable portion 220 has the point of effort (the arm portion 242) and the point of action (the arm portion 243), which are in mutually different positions in the axial line direction of the rotating shaft 201 (mutually different positions in the front-rear direction in the present embodiment). When the external force is exerted on the arm portion 242 in the predetermined direction (the downward direction in the present embodiment), the urging force in the first operating direction is imparted to the movable portion 220 at the arm portion 243 and the cutting blade 223 moves in the direction to come into close proximity to the receiving base 213. The regulating pin 250, which regulates the movement of the movable portion 220 in the axial line direction (toward the front in the present embodiment) in which the elastic deformation of the compression spring 240 occurs, is provided in the axial line direction with respect to the movable portion 220.

In this manner, when the tape is cut, the movement of the movable portion 220 in the axial line direction of the rotating shaft 201 is regulated by the regulating pin 250. As the posture and position of the cutting blade 223 that is approaching the receiving base 213 are stable, the tape is cut in a stable manner. As the cutting blade 223 is inhibited from being pressed against the tape in a direction that is different to an appropriate cutting direction, wear and deterioration of the cutting blade 223 are reduced. Due to the posture and the position of the cutting blade 223 being stable, the gap between the cutting blade 223 and the receiving base 213 is uniform when the tape is cut. Thus, the tape may be accurately cut.

(7) When the elastic deformation occurs in the compression spring 240, the arm portion 242 separates from the latching plate 225 of the movable portion 220. The urging force to the axial line direction that occurs at the time of the elastic deformation of the compression spring 240 is inhibited in this manner, and the load applied on the regulating pin 250 by the movable portion 220 is reduced. The arm portion 242 easily attaches to and detaches from the latching plate 225, and thus a manufacturing operation to assemble the compression spring 240 on the movable portion 220 becomes easier.

(8) At least a part of the regulating pin 250 is the circular column portion 251 that comes into contact with the movable portion 220 when the elastic deformation occurs in the compression spring 240. At the time of the elastic deformation of the compression spring 240, the movable portion 220 comes into contact with the outer peripheral surface of the circular column portion 251 at one point in a plan view, and thus an area of contact between the circular column portion 251 and the movable portion 220 is small. At the time of the elastic deformation of the compression spring 240, the movement of the movable portion 220 is regulated over an even smaller area of contact. Thus, the movable portion 220 may be held in an accurate posture and position.

(9) The end portion of the regulating pin 250 in the second operating direction (the upper end in the present embodiment) is the tapered portion 252 whose diameter decreases toward the upward direction. When the movable portion 220 rotates in the first operating direction, the tapered portion 252 faces the movable portion 220 before the elastic deformation of the compression spring 240 occurs. Thus, the movable portion 220 that rotates in the first operating direction may be guided toward the circular column portion 251 before the elastic deformation of the compression spring 240 occurs.

(10) The fixed portion 210 is the member on which the receiving base 213 is provided and is fixed to the movable portion 220 while being aligned with the movable portion 220 in the axial line direction of the rotating shaft 201. The protruding portion 800 is provided on the movable portion 220 in the position facing the fixed portion 210 and protrudes toward the fixed portion 210. In this manner, the gap (that is, the backlash) between the movable portion 220 and the fixed portion 210 is reduced, and thus it is possible to stabilize the posture and the position of the movable portion 220 that rotates in the first operating direction.

(11) The first drive pin 763 exerts the external force, which operates in a specific direction, on the movable portion 220 by pressing the compression spring 240. When the movable portion 220 rotates in the first operating direction as far as the first cutting position, the compression spring 240 elastically deforms in response to the external force. The distance from the rotating shaft 201 to the first drive pin 763 is substantially equal to the distance from the rotating shaft 201 to the regulating pin 250. Thus, the regulating pin 250 may reliably regulate the movement of the movable portion 220 on the side of the vector direction that causes the movable portion 220 to move to the axial line direction.

(12) When the cutting blade 223 is in close proximity to the receiving base 213, the gap forming portion 231 forms the gap between the cutting blade 223 and the receiving base 213 such that the gap is substantially equal to the thickness of part of the layers included in the tape. In the state in which the gap is formed by the gap forming portion 231, the compression spring 240 holds the position of the first drive pin 763. In this way, even if the driving of the cutter drive motor 90 is stopped, the cutting blade 223 may be held in the state of close proximity to the receiving base 213.

(13) The first drive pin 763 presses the compression spring 240 in conjunction with the forward rotation of the cutter drive motor 90. In this way, it is possible to cause the cutting blade 223 to be in close proximity to the receiving base 213 and to cut the tape using the drive control of the cutter drive motor 90.

(14) By the second drive pin 764 pressing the movable portion 320 in conjunction with the reverse rotation of the cutter drive motor 90, the urging force, which operates in the direction that causes the movable blade 324 to be in close proximity to the fixed blade 314, is applied to the movable portion 320. In this way, it is possible to selectively perform the full cutting and the half cutting of the tape using the drive control of the single cutter drive motor 90.

(15) In the tape printer 1 of the present embodiment, the tape is printed by the printing mechanism 71 and is supplied to the cutting mechanism 80. Thus, after the tape has been printed, the printed tape may be cut in a stable manner.

Modified Examples

The present disclosure is not limited to the above-described embodiment, and various modifications are possible. The cutting mechanism 80 need not necessarily be provided in the tape printer 1. The cutting mechanism 80 may be a device that can be used independently, or may be a part of another device that uses a medium (a tape, for example). The cutting mechanism 80 is not limited to the device that is driven by the cutter drive motor 90, and may be a device that cuts a tape by manual operation by a user.

The compression spring 240 may be another elastic member (a plate spring, an elastic rubber, or the like). The compression spring 240 and the regulating pin 250 may be provided on the full-cut mechanism 300. In this way, in a similar manner to the half-cut mechanism 200 of the above-described embodiment, the movement of the movable portion 320 may be regulated when fully cutting the tape and the full cutting of the tape may be performed in a stable manner.

Figure 20:
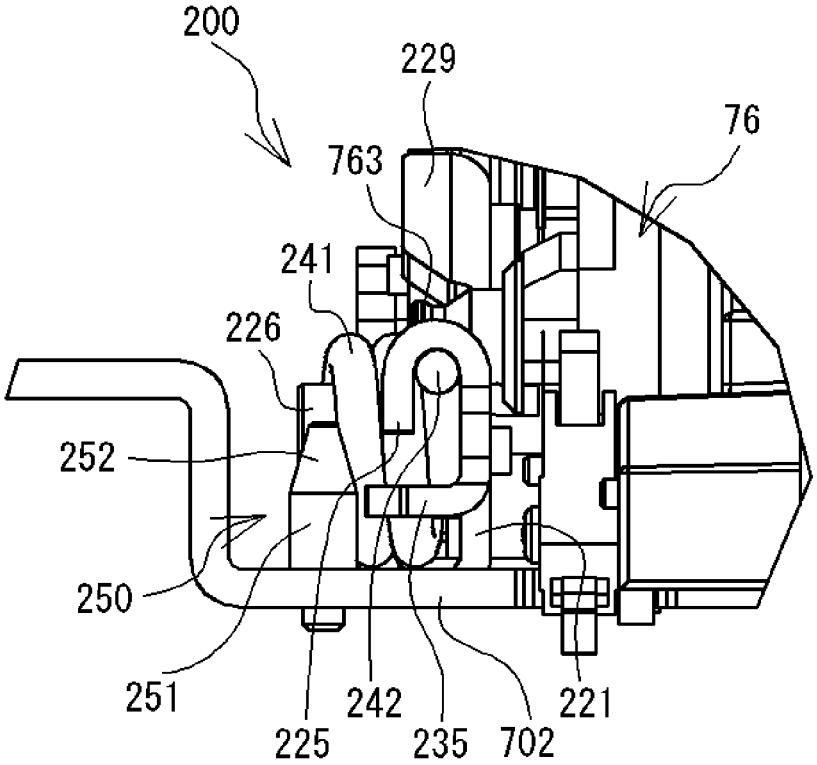
FIG. 20 is a right side enlarged view of the half-cut mechanism according to a modified example.

As shown in FIG. 20, the latching plate 225 of a modified example is a wall portion that extends in the up-down direction and that comes into contact with the point of effort (the arm portion 242) of the compression spring 240. The latching plate 225 of the modified example is a guide wall that guides, in the downward direction, the point of effort (the arm portion 242) that moves in response to the elastic deformation of the compression spring 240. In this manner, the movable portion 220 may be caused to rotate in an appropriate posture in accordance with the elastic deformation of the compression spring 240. At the time of cutting the tape, by the compression spring 240 that is elastically deformed, a vector component that accords with a design value that has been calculated in advance operates on the movable portion 220. Thus, the design and the manufacturing of the cutting mechanism 80 become simple.

The shape, full length, diameter and position etc. of the regulating pin 250 can be changed. For example, it is sufficient that the circular column portion 251 of the regulating pin 250 be provided in a position that faces the movable portion 220 at least when the elastic deformation of the compression spring 240 occurs. A prismatic column portion or a circular cone portion may be provided in place of the circular column portion 251.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cutting device comprising:

a receiving base configured to receive a medium arranged thereon;

a first movable portion having a cutting blade, the cutting blade being configured to cut the medium between the cutting blade and the receiving base, the first movable portion being configured to move between a first retracted position and a first cutting position, the first retracted position being a position in which the cutting blade is separated by at least a specific distance from the receiving base, and the first cutting position being a position in which the cutting blade is closer to the receiving base than in the first retracted position;

a rotation drive portion configured to rotate in a first rotation direction and a second rotation direction that are mutually opposite directions;

a first operating portion that is a movable body configured to move in conjunction with the rotation drive portion, the first operating portion being configured to move in a first movement direction in accordance with rotation of the rotation drive portion in the first rotation direction, and to move in a second movement direction in accordance with rotation of the rotation drive portion in the second rotation direction, the second movement direction being a direction opposite to the first movement direction, the first operating portion also being configured to cause the first movable portion to move toward the first cutting position in accordance with the movement of the first operating portion in the first movement direction, and to cause the first movable portion to move toward the first retracted position in accordance with the movement of the first operating portion in the second movement direction;

a drive stopping portion configured to stop the rotation of the rotation drive portion that rotates in the first rotation direction, when the first movable portion reaches the first cutting position;

a position holding portion configured to hold a position of the first operating portion that moves in the first movement direction, when the first movable portion reaches the first cutting position;

a fixed blade that is provided facing a position at which the medium is arranged;

a second movable portion having a movable blade, the movable blade being configured to cut the medium between the movable blade and the fixed blade, the second movable portion being configured to move between a second retracted position and a second cutting position, the second retracted position being a position in which the movable blade is separated from the fixed blade, and the second cutting position being a position in which the movable blade intersects with the fixed blade; and a second operating portion that is a movable body configured to move in conjunction with the rotation drive portion, the second operating portion being configured to move in a third movement direction in accordance with the rotation of the rotation drive portion in the second rotation direction and to move in a fourth movement direction in accordance with the rotation of the rotation drive portion in the first rotation direction, the fourth movement direction being a direction opposite to the third movement direction, the second operating portion also being configured to cause the second movable portion to move toward the second cutting position in accordance with the movement of the second operating portion in the third movement direction and to cause the second movable portion to move toward the second retracted position in accordance with the movement of the second operating portion in the fourth movement direction.

2. The cutting device according to claim 1, further comprising:

a feed roller that is a rotating body configured to come into contact with the medium that faces the fixed blade; and a roller rotation portion configured to cause the feed roller to rotate in accordance with the second movable portion coming into close proximity to and moving away from the second cutting position;

wherein the feed roller is configured to feed, in a predetermined direction, the medium that is cut between the fixed blade and the movable blade, in accordance with the feed roller being rotated by the roller rotation portion.

3. The cutting device according to claim 1, further comprising:

a common movable portion that is a movable body configured to move in conjunction with the rotation drive portion, the common movable portion including the first operating portion and the second operating portion; and a detection portion configured to detect the common movable portion;

wherein the first operating portion is configured to move the first movable portion to the first cutting position when the common movable portion moves to a first position, the second operating portion is configured to move the second movable portion to the second cutting position when the common movable portion moves to a second position, the detection portion is configured to detect the common movable portion when the common movable portion is in one of the first position and the second position, and the drive stopping portion is configured to stop the rotation of the rotation drive portion when the common movable portion is detected by the detection portion.

4. A cutting device comprising:

a receiving base configured to receive a medium arranged thereon;

a first movable portion having a cutting blade, the cutting blade being configured to cut the medium between the cutting blade and the receiving base, the first movable portion being configured to move between a first retracted position and a first cutting position, the first retracted position being a position in which the cutting blade is separated by at least a specific distance from the receiving base, and the first cutting position being a position in which the cutting blade is closer to the receiving base than in the first retracted position;

a rotation drive portion configured to rotate in a first rotation direction and a second rotation direction that are mutually opposite directions;

a first operating portion that is a movable body configured to move in conjunction with the rotation drive portion, the first operating portion being configured to move in a first movement direction in accordance with rotation of the rotation drive portion in the first rotation direction, and to move in a second movement direction in accordance with rotation of the rotation drive portion in the second rotation direction, the second movement direction being a direction opposite to the first movement direction, the first operating portion also being configured to cause the first movable portion to move toward the first cutting position in accordance with the movement of the first operating portion in the first movement direction, and to cause the first movable portion to move toward the first retracted position in accordance with the movement of the first operating portion in the second movement direction;

a drive stopping portion configured to stop the rotation of the rotation drive portion that rotates in the first rotation direction, when the first movable portion reaches the first cutting position;

a position holding portion configured to hold a position of the first operating portion that moves in the first movement direction, when the first movable portion reaches the first cutting position;

an urging portion configured to urge the first movable portion toward the first retracted position; and a contact portion configured to come into contact, from the second movement direction, with the first operating portion that moves in the first movement direction, when the first movable portion reaches the first cutting position, wherein:

the first movable portion is configured to move toward the first cutting position due to a pressing force of the first operating portion in accordance with the first operating portion moving in the first movement direction, and to move toward the first retracted position due to an urging force of the urging portion in accordance with the first operating portion moving in the second movement direction, and the position holding portion is an elastic body configured to urge the first operating portion toward the contact portion when the position holding portion comes into contact with the first operating portion that presses the first movable portion and when the first movable portion reaches the first cutting position.

5. The cutting device according to claim 4, further comprising:

a regulating portion configured to regulate movement of the first movable portion;

wherein the first movable portion is configured to rotate around a rotating shaft such that the cutting blade comes into close proximity to moves away from the receiving base, the position holding portion is provided on the first movable portion, the position holding portion being configured to have a point of effort and a point of action, which are in mutually different positions in an axial line direction of the rotating shaft, the position holding portion being configured to impart an urging force on the first movable portion in a first operating direction at the point of action when the position holding portion is subject to an external force that operates on the point of effort in a specific direction, the first operating direction being a rotation direction of the first movable portion that causes the cutting blade to come into close proximity to the receiving base, and the regulating portion is provided on a side of the axial line direction with respect to the first movable portion, the regulating portion being configured to regulate movement of the first movable portion in the axial line direction when elastic deformation of the position holding portion occurs.

6. The cutting device according to claim 5, wherein the point of effort is configured to move away from the first movable portion when the elastic deformation of the position holding portion occurs.

7. The cutting device according to claim 6, wherein the first movable portion includes a guide wall, which is a wall portion configured to come into contact with the point of effort, the guide wall being configured to guide the point of effort that moves in accordance with the elastic deformation of the position holding portion.

8. The cutting device according to claim 5, wherein at least a part of the regulating portion is a columnar portion configured to come into contact with the first movable portion when the elastic deformation of the position holding portion occurs.

9. The cutting device according to claim 8, wherein an end portion of the regulating portion in a second operating direction is a tapered portion whose diameter decreases toward the second operating direction, the second operating direction being a rotation direction of the first movable portion that causes the cutting blade to move away from the receiving base, and the tapered portion is configured to face the first movable portion before the elastic deformation of the position holding portion occurs, when the first movable portion rotates in the first operating direction.

10. The cutting device according to claim 5, further comprising:

a fixed portion on which the receiving base is provided, the fixed portion being aligned with the first movable portion in the axial line direction and being connected to the first movable portion; and a protruding portion that is provided on the first movable portion, in a position facing the fixed portion, the protruding portion protruding toward the fixed portion.

11. The cutting device according to claim 5, wherein the first operating portion is configured to exert the external force on the first movable portion by pressing the point of effort, the position holding portion is configured to elastically deform in accordance with the external force when the first movable portion rotates in the first operating direction as far as the first cutting position, and a distance from the rotating shaft to the first operating portion is substantially the same as a distance from the rotating shaft to the regulating portion.

12. The cutting device according to claim 11, wherein the first operating portion is configured to press the point of effort in conjunction with the rotation in the first rotation direction of the rotation drive portion.

13. The cutting device according to claim 12, further comprising:

a fixed blade that is provided facing a position at which the medium is arranged;

a second movable portion having a movable blade, the movable blade being configured to cut the medium between the movable blade and the fixed blade, the second movable portion being configured to rotate around a rotating shaft such that the movable blade comes into close proximity to or moves away from the fixed blade; and a second operating portion configured to impart, to the second movable portion, an urging force that operates in a direction that causes the movable blade to come into close proximity to the fixed blade, by pressing the second movable portion in conjunction with the rotation in the second rotation direction of the rotation drive portion.

14. The cutting device according to claim 4, further comprising:

a gap forming portion configured to form a gap between the cutting blade and the receiving base in a state in which the first movable portion is in the first cutting position, the gap being substantially the same as a thickness of part of a plurality of layers of the medium in which the plurality of layers are laminated.

15. The cutting device according to claim 14, wherein the position holding portion is configured to hold the position of the first operating portion in a state in which the gap is formed by the gap forming portion.

16. A printer comprising:

a receiving base configured to receive a medium arranged thereon;

a printing portion configured to print the medium;

a supply portion configured to supply the medium printed by the printing portion to the receiving base;

a first movable portion having a cutting blade, the cutting blade being configured to cut the medium between the cutting blade and the receiving base, the first movable portion being configured to move between a first retracted position and a first cutting position, the first retracted position being a position in which the cutting blade is separated by at least a specific distance from the receiving base, and the first cutting position being a position in which the cutting blade is closer to the receiving base than in the first retracted position;

a rotation drive portion configured to rotate in a first rotation direction and a second rotation direction that are mutually opposite directions;

a first operating portion that is a movable body configured to move in conjunction with the rotation drive portion, the first operating portion being configured to move in a first movement direction in accordance with rotation of the rotation drive portion in the first rotation direction, and to move in a second movement direction in accordance with rotation of the rotation drive portion in the second rotation direction, the second movement direction being a direction opposite to the first movement direction, the first operating portion also being configured to cause the first movable portion to move toward the first cutting position in accordance with the movement of the first operating portion in the first movement direction, and to cause the first movable portion to move toward the first retracted position in accordance with the movement of the first operating portion in the second movement direction;

a drive stopping portion configured to stop the rotation of the rotation drive portion that rotates in the first rotation direction, when the first movable portion reaches the first cutting position;

a position holding portion configured to hold a position of the first operating portion that moves in the first movement direction, when the first movable portion reaches the first cutting position;

an urging portion configured to urge the first movable portion toward the first retracted position; and a contact portion configured to come into contact, from the second movement direction, with the first operating portion that moves in the first movement direction, when the first movable portion reaches the first cutting position, wherein:

the first movable portion is configured to move toward the first cutting position due to a pressing force of the first operating portion in accordance with the first operating portion moving in the first movement direction, and to move toward the first retracted position due to an urging force of the urging portion in accordance with the first operating portion moving in the second movement direction, and the position holding portion is an elastic body configured to urge the first operating portion toward the contact portion when the position holding portion comes into contact with the first operating portion that presses the first movable portion and when the first movable portion reaches the first cutting position.

17. The printer according to claim 16, further comprising:

a regulating portion configured to regulate movement of the first movable portion;

wherein the first movable portion is configured to rotate around a rotating shaft such that the cutting blade comes into close proximity to or is separated from the receiving base, the position holding portion is an elastic member that is provided on the first movable portion, the position holding portion being configured to have a point of effort and a point of action, which are in mutually different positions in an axial line direction of the rotating shaft, the position holding portion being configured to impart an urging force on the first movable portion in a first operating direction at the point of action when the position holding portion is subject to an external force that operates on the point of effort in a specific direction, the first operating direction being a rotation direction of the first movable portion that causes the cutting blade to come into close proximity to the receiving base, and the regulating portion is provided on a side of the axial line direction with respect to the first movable portion, the regulating portion being configured to regulate movement of the first movable portion in the axial line direction when elastic deformation of the position holding portion occurs.

* * * * *